US005251856A

United States Patent [19]

Young et al.

[11] Patent Number: 5,251,856

[45] Date of Patent: Oct. 12, 1993

[54] MODEL TRAIN CONTROLLER FOR REVERSING UNIT

[75] Inventors: Neil P. Young, 3240 Bear Gulch Rd., Redwood City, 94062; Richard Davis, Palo Alto; both of Calif.

[73] Assignee: Neil P. Young, Redwood City, Calif.

[21] Appl. No.: 833,869

[22] Filed: Feb. 11, 1992

[51] Int. Cl.[5] ..... B61L 7/08; B61L 27/00

[52] U.S. Cl. ..... 246/4; 246/187 A; 246/191; 104/300; 104/302; 340/825.69

[58] Field of Search ..... 246/3, 4, 5, 167 R, 246/187 R, 187 A, 187 B, 191; 104/300, 301, 302, DIG. 1; 340/825.17, 825.69, 825.72

[56] References Cited

U.S. PATENT DOCUMENTS

| | | | |
|---|---|---|---|
| 2,221,963 | 11/1940 | Case et al. | 246/4 X |
| 2,606,281 | 8/1952 | Thomas et al. . | |
| 2,830,148 | 4/1958 | Barger . | |
| 2,963,985 | 12/1960 | Palmer . | |
| 3,220,356 | 11/1965 | Leslie . | |
| 3,293,549 | 12/1966 | Patterson | 246/187 A X |
| 3,315,613 | 4/1967 | Leslie | 104/301 X |
| 3,529,216 | 9/1970 | Kolm et al. . | |
| 3,587,100 | 6/1971 | Doremus et al. . | |
| 3,639,755 | 2/1972 | Wrege | 340/825.69 X |
| 3,699,522 | 10/1972 | Haner, Jr. . | |
| 3,810,099 | 5/1974 | Woods . | |
| 3,964,701 | 6/1976 | Kacerek | 104/300 X |
| 3,994,237 | 11/1976 | Thomsen | 104/301 X |
| 4,334,221 | 6/1982 | Rosenhagen et al. . | |
| 4,335,381 | 6/1982 | Palmer | 246/187 A X |
| 4,349,196 | 9/1982 | Smith, III et al. | 246/5 X |
| 4,390,877 | 6/1983 | Curran . | |
| 4,572,996 | 2/1986 | Hanschke et al. . | |
| 4,711,418 | 12/1987 | Aver, Jr. et al. | 246/5 |
| 4,723,737 | 2/1988 | Mimoun . | |
| 4,914,431 | 4/1990 | Severson et al. . | |
| 5,012,236 | 4/1991 | Troyk et al. | 340/825.54 |
| 5,146,153 | 9/1992 | Luchaco et al. | 340/825.69 X |

OTHER PUBLICATIONS

Excerpt from Lionel Brochure entitled "Lionel 'E-Units'" pp. 231-234.

*Primary Examiner*—David A. Bucci
*Assistant Examiner*—Scott L. Lowe
*Attorney, Agent, or Firm*—Townsend and Townsend Khourie and Crew

[57] ABSTRACT

A control circuit which will momentarily apply a pulse of power to the E-Unit solenoid in response to the momentary interruption of power by the transformer or another control signal. The E-Unit rest state is thus with no power applied, eliminating noise and saving power. A seek-to-forward cycling capability is also provided. The overall system has a remote transmitter and a base unit coupled to the train tracks with a receiver. The base unit controls track switching and individual trains through FSK signals transmitted over the track. The base unit also controls a triac switch between the transformer and the track to allow remote control of track power and impose DC offsets on the track power signal.

9 Claims, 15 Drawing Sheets

MODEL TRAIN CONTROLLER FOR REVERSING UNIT

BACKGROUND

The present invention relates to control systems for model trains, and in particular to Lionel trains with an "E-Unit" electrical motor direction reversing unit.

Model train systems have been in existence for many years. In the typical system, the model train engine is an electrical engine which receives power from a voltage which is applied to the tracks and picked up by the train motor. A transformer is used to apply the power to the tracks. The transformer controls both the amplitude and polarity of the voltage, thereby controlling the speed and direction of the train. In HO systems, the voltage is a DC voltage. In Lionel systems, the voltage is an AC voltage, the 60 Hz line voltage available in a standard wall socket.

In addition to controlling the direction and speed of a train, model train enthusiasts have a desire to control other features of the train, such as a whistle. Lionel allows for such control of the whistle by imposing a DC voltage on top of the AC line voltage, which is then picked up by the locomotive. Obviously, this method is limited in the number of controls that can be transmitted, since there are only plus and minus DC levels available, along with varying amplitudes. One method for increasing the number of control signals available by use of a state machine in the locomotive is disclosed in Severson, U.S. Pat. No. 4,914,431.

Another type of control system is shown in Hanschke et al., U.S. Pat. No. 4,572,996. This patent teaches sending address and control signals over a rail line bus to a train. The signals sent appear to be digital pulses. In Kacerek, U.S. Pat. No. 3,964,701, each train locomotive will respond to a different frequency signal. After the corresponding frequency signal is sent to alert the train, it is followed by a voltage level indicating the action to be taken.

Originally, Lionel trains used a mechanical lever on the locomotive to reverse the direction of the train. The introduction of the E-Unit allowed remote control of the direction of the train. The E-Unit is mounted on the locomotive and has a solenoid coil which is provided power from the train track. When power is removed momentarily, the solenoid coil relaxes and the plunger from the solenoid dislodges a pawl (pivoting arm) away from a ratchet tooth of a drum. When the solenoid is reactivated by reapplying power, the plunger is withdrawn upward, whereby the pawl catches a tooth on the drum, thereby rotating to the next state. The drum has contacts on it which connect with spring contacts from the track power and the motor. The contacts switch as the drum is rotated to interchange the connections of the motor armature with respect to the motor field. The rotating drum will sequence the motor through forward, neutral before reverse, reverse, and neutral before forward.

One disadvantage of the E-Unit is the very nature of its control by removing power. Power can be removed unintentionally by unwanted power interruptions such as a dirty track or loose connections. This can cause the E-Unit to change its state when it should not. In addition, the nature of the E-Unit requires that the solenoid be on all the time that the motor is in a particular position. This results in a continuous buzz emitted by the E-Unit during operation and a significant power drain.

This audible buzz is due to the applied AC field mechanically vibrating the plunger and increases with the applied voltage.

One solution to the E-Unit problems is to substitute a new control system with a modified E-Unit. The new control system can operate by sending control signals to the locomotive, rather than by interrupting power on the train track. However, a disadvantage of this system is that a new train equipped for operating in such a control system will not operate when placed on an older train track system which provides control by momentarily removing power. Thus, one could not take one's locomotives to a friend's track system and be assured of compatibility.

SUMMARY OF THE INVENTION

The present invention provides a control circuit which will momentarily apply power to the E-Unit solenoid in response to the momentary interruption of power by the transformer. After the E-Unit drum has advanced, the solenoid has power removed, allowing the plunger to drop into the position where it dislodges the pawl. This is then the rest state of the E-Unit, with power removed and no noise emanating. The E-Unit is relaxed, and loaded for the next state. The first half of the rotation operation is done ahead of time, the dislodging of the pawl. However, this does not change the contact position, which will occur when the drum rotates upon the plunger being drawn up when power is reapplied after the next power interruption.

In one embodiment, a detector for determining when the plunger is in the withdrawn position is provided. When the plunger is determined to be seated, a relay is activated to disconnect power from the solenoid. This relay will be deactivated, allowing power to be reapplied to the solenoid, when power is dropped from the tracks in the next E-Unit control cycle.

In one embodiment, the phase of the current and voltage through the E-Unit is monitored and used to determine the position of the plunger and when power can be removed. In an alternate embodiment, a pulse-width is set for the particular E-Unit to be of a duration sufficient to cause it to change position. Multiple leads on the E-Unit are monitored to determine the position of the E-Unit. A seek-to-forward capability is provided allowing the E-Unit to be stepped through its positions until the engine is in the forward gear. This is accomplished using the normal interruption of track power and the whistle signal of a Lionel unit, which provides a DC offset. The position of the E-Unit is cycled with an oscillator, and monitored until it is in the forward position, at which point the oscillator is disabled.

By having a steady state condition with power removed from the solenoid, the undesirable buzz of the solenoid is removed. In addition, by having the normal condition with power off, the unwanted triggering of the E-Unit by dirty tracks or loose connections is avoided.

The present invention also provides a control system in which a remote unit is used to transmit signals to a base unit connected between the transformer and the track. The base unit then transmits signals to particular engines using a digital address which is imposed upon the track power signal. Preferably, this is done with a frequency shift key (FSK) modulation technique which is relatively immune to noise caused by variations in the amplitude of the power signal on the track. Each locomotive has a receiver unit which looks for its address, and receives data corresponding to its address. This data is then used to control operation of various elements of the locomotive, including its direction. This can be done by an override connection to the E-Unit controller of the present invention. This circuit thus not only allows remote control using digitally coded control signals independent of track power, but also allows backward compatibility with systems which use the removal of the track power to control the E-Unit of a locomotive.

The present invention also provides circuitry for allowing remote control of the track power. A triac switch is placed between the transformer and the track. The transformer is placed on full power, with the power being controlled by the triac. Remote control signals from the hand-held unit are directed to a separate controller in the base unit, which controls the triac switch. This controller controls the switching on time of the triac in order to vary the power applied to the track. In addition, the phase of the triac switching is controlled to impose a DC offset as desired.

For a fuller understanding of the nature and advantages of the invention, reference should be made to the ensuing description taken in conjunction with the accompanying drawings.

DETAILED DESCRIPTION OF THE PREFERRED EMBODIMENTS

Figure 1:
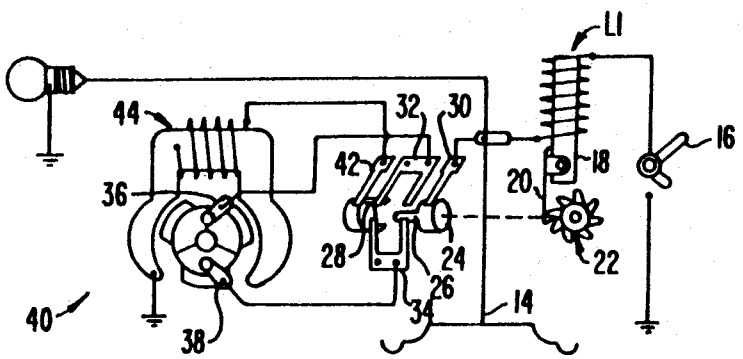
FIG. 1. PRIOR ART
FIG. 1 is a schematic diagram of an E-Unit according to the prior art.

FIG. 1 is a schematic diagram of a standard E-Unit. An E-Unit coil L1 receives power from contact sliders 14 which pass through the coil to ground through a manual override switch 16. When power is applied, a plunger 18 is pulled up within E-Unit coil L1. When power is removed, plunger 18 will descend, forcing pawl 20 away from ratchet assembly 22. This will cause the pawl 20 to disengage a tooth of ratchet assembly 22, so that when power is applied again and plunger 18 is removed, ratchet assembly 22 will rotate to the next tooth which will be engaged by pawl 20.

This rotation rotates a drum 24 physically connected to the ratchet. Drum 24 has different contact regions on its face, such as contacts 26 and 28. These contacts connect with various spring contacts biased against the drum depending upon the position. Power is applied through a first contact 30. Contacts 32 and 34 are connected to brushes 36 and 38 of motor 40. Contact 42 is connected to the motor field winding 44.

As plunger 18 moves up and down, it rotates ratchet wheel assembly 22, rotating drum 24 and changing the connection to the motor to move it from forward, to neutral, to reverse, and back to neutral again.

Figure 2:
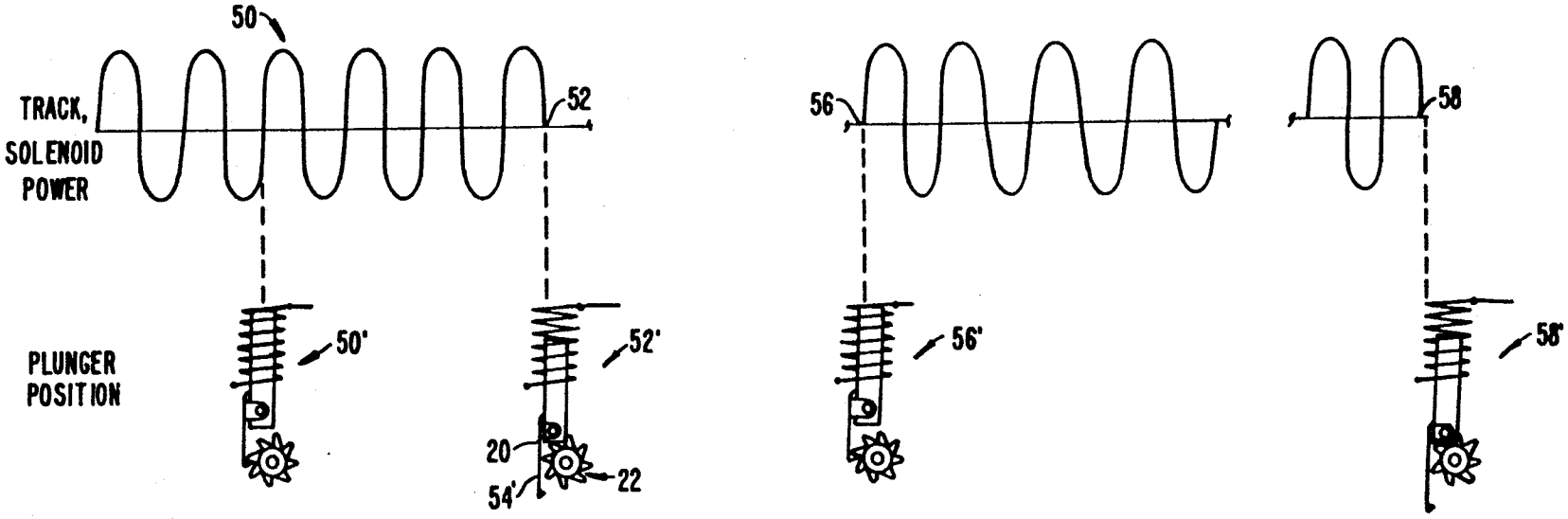
FIG. 2. PRIOR ART
FIG. 2 is a timing diagram illustrating the position of the plunger of the E-Unit during the removal and application of track power according to the prior art.

FIG. 2 is a timing diagram illustrating the position of the plunger with respect to the applied power to the track and the solenoid. In a first time period 50, AC power is applied, and the plunger is in an up position as illustrated by plunger diagram 50'. A power interruption between times 52 and 56 is used to switch the E-Unit. When power is removed at a time 52, the plunger drops down as shown in plunger diagram 52' due to the removal of power. This causes pawl 20 to become disengaged from tooth 54 of ratchet wheel assembly 22. At this point, no connections have been changed, the pawl 20 has simply been disengaged.

When power is reapplied at a time 56, the plunger is retracted to the position shown in 56', with the pawl pulling on a tooth of ratchet wheel assembly 22 to rotate the ratchet wheel. This rotation causes the change in connections to the motor, from forward to neutral, for example. At a time 58, power is removed again, causing the plunger to drop again as shown in position 58'. To move the train from forward to reverse, for example, power must be interrupted twice, the first interruption will cause the ratchet wheel to move one position from forward to neutral, and the second power interruption will move the ratchet wheel again from neutral to reverse.

Figure 3:
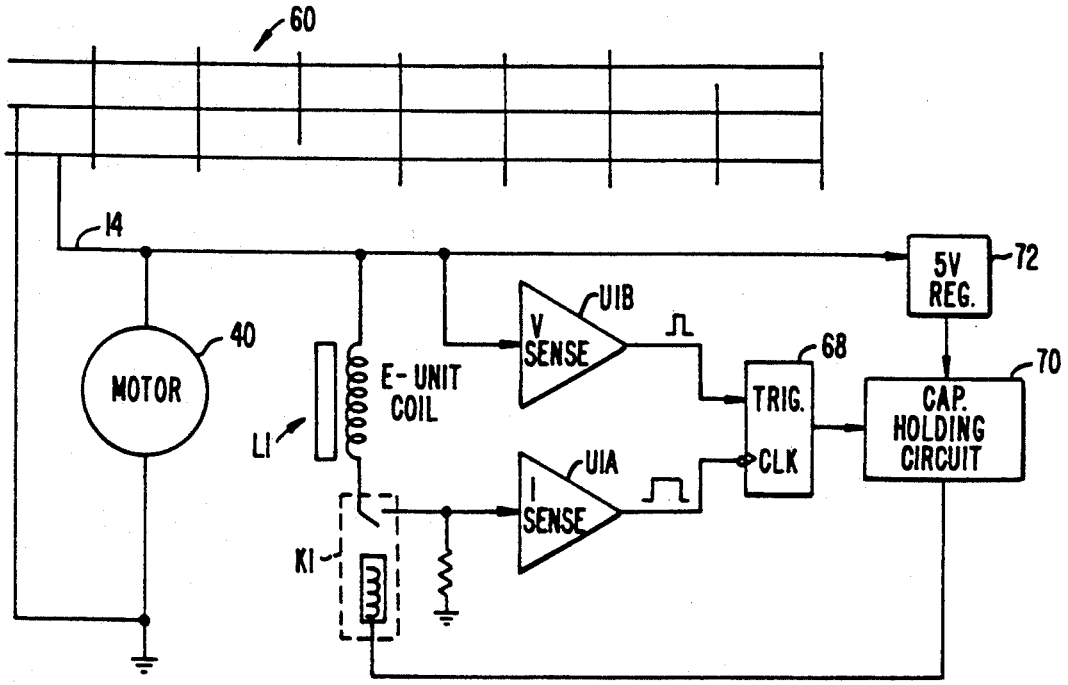
FIG. 3 is a block diagram of an AC E-Unit controller according to the present invention.

FIG. 3 is a block diagram of a preferred embodiment of an AC E-Unit control circuit of the present invention. The invention uses the same motor 40 and E-Unit coil L1 connected to AC power contacts 14 as shown in FIG. 1. Contacts 14 pick up power from train tracks 60. The circuit of FIG. 3 uses a relay K1 to interrupt power to the E-Unit coil L1 after the plunger has been retracted to within the coil. The detection that the plunger has retracted to within the coil can be done in a number of ways. In this embodiment it is done by sensing the current through the coil with a current sense circuit U1A, and also sensing the voltage applied to the coil through a voltage sense circuit U1B. Initially, before the plunger is retracted, the current sense output will be in phase with the voltage output, and will block the triggering of a pulse at the output of a trigger circuit 68. However, as the plunger is retracted, the pulse output of current sense circuit U1A will vary in phase until it no longer blocks the pulse output of voltage sense circuit U1B. This will cause a trigger pulse from circuit 68 to be applied to capacitive holding circuit 70, which activates relay K1. Since only a pulse is generated by circuit 68, a capacitor in circuit 70 holds the voltage on relay K1, maintaining the switch in its open position and power removed from E-Unit coil L1. Holding circuit 70 is powered by a voltage regulator 72, which receives its power from the AC track voltage on line 14. When the track voltage is removed, pulses from U1B will no longer be supplied to capacitive holding circuit 70, allowing its output voltage to decay. This will remove power from relay K1, closing the switch in relay K1 to allow current to flow again through E-Unit coil L1 when power is reapplied. The circuit will cause the K1 switch to close before enough power is applied to cause the train motor to turn. This prevents the motor from jumping and maintains the existing stall or holding voltage at which the train won't move.

Figure 4:
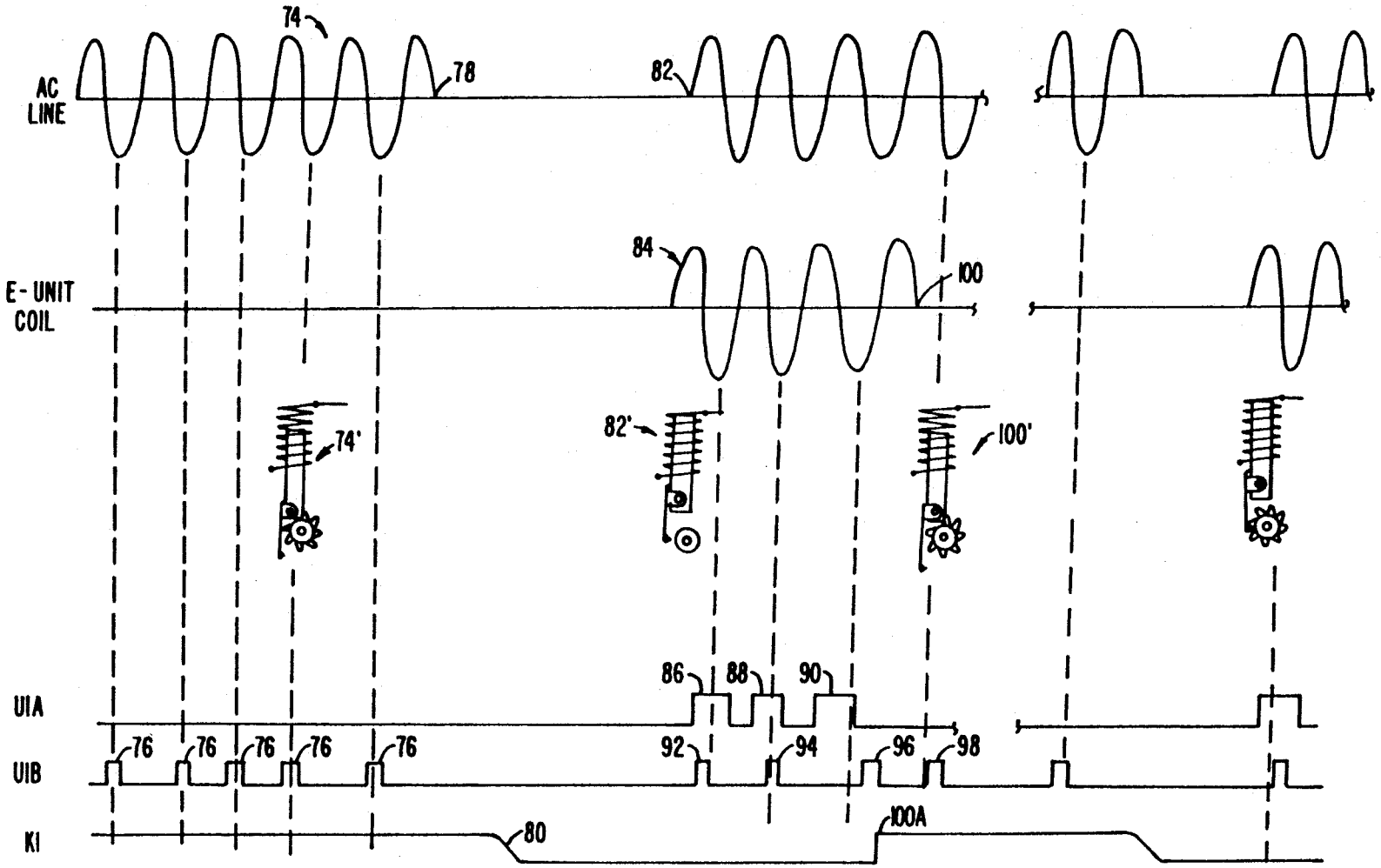
FIG. 4 is a timing diagram illustrating the position of an E-Unit plunger with respect to different signals of the block diagram of FIG. 3.

FIG. 4 is a timing diagram illustrating the operation of the circuit of FIG. 3. While power is applied in an initial period 74, the E-Unit is in down position shown as 74'. At this time, relay K1 is on, removing power from the current sense unit U1A, which is shown as having no signal at this point. But the voltage is still applied to the motor and across the voltage sense unit U1B, producing a series of pulses 76 at the output of U1B corresponding to each negative cycle of the AC power signal. These pulses continue to pulse capacitive holding circuit 70, recharging the capacitor and holding the relay in the ON position to keep power removed from the E-Unit coil. The signal to relay K1 is shown as a high signal.

At a time 78, power is removed from the AC line in the same manner shown in FIG. 2 in order to cycle the motor. Note that in FIG. 2 this caused the plunger to drop, while in the present invention, the plunger is already in the drop position. A short time after time 78, the K1 signal goes low at a time 80 due to the absence of any additional pulses to capacitive holding circuit 70, causing a decay of the K1 signal. This removes power from the K1 relay, which then will close as power is lost. When this happens, power is reapplied to the E-Unit coil. Thus, when power is reapplied to the AC line at time 82, it is also simultaneously applied to the E-Unit coil as shown by waveform 84. This causes the plunger to be withdrawn up into the coil as indicated by diagram 82'.

Since relay K1 has its switch closed, U1A now receives current pulses and produces pulse output signals. These are indicated as pulses 86, 88 and 90, respectively. At the same time, voltage sense unit U1B is producing pulses 92, 94, 96 and 98. As the plunger is withdrawn to within the coil, the phase relationship of the U1A pulses compared to the U1B pulses varies. Initially, the U1A pulses occur at the same time as the U1B pulses, allowing it to mask the output of trigger circuit 68, preventing an output. But as can be seen, after pulse 90 of U1A, the phase is changed so much that pulse 96 of U1B is allowed to produce a trigger signal without being masked. This trigger signal activates relay K1, removing power from E-Unit coil L1 at a time 100 and dropping the plunger as indicated by 100'. This also eliminates the signal to current sense circuit U1A, eliminating this output pulse. As can be seen, the K1 waveform jumps up at time 100A, corresponding to time 100. The plunger is now in the same position as is shown at 74', waiting for the next interruption of power to allow the E-Unit to cycle again. This enables faster cycling when the user decides to change states.

Figure 5:
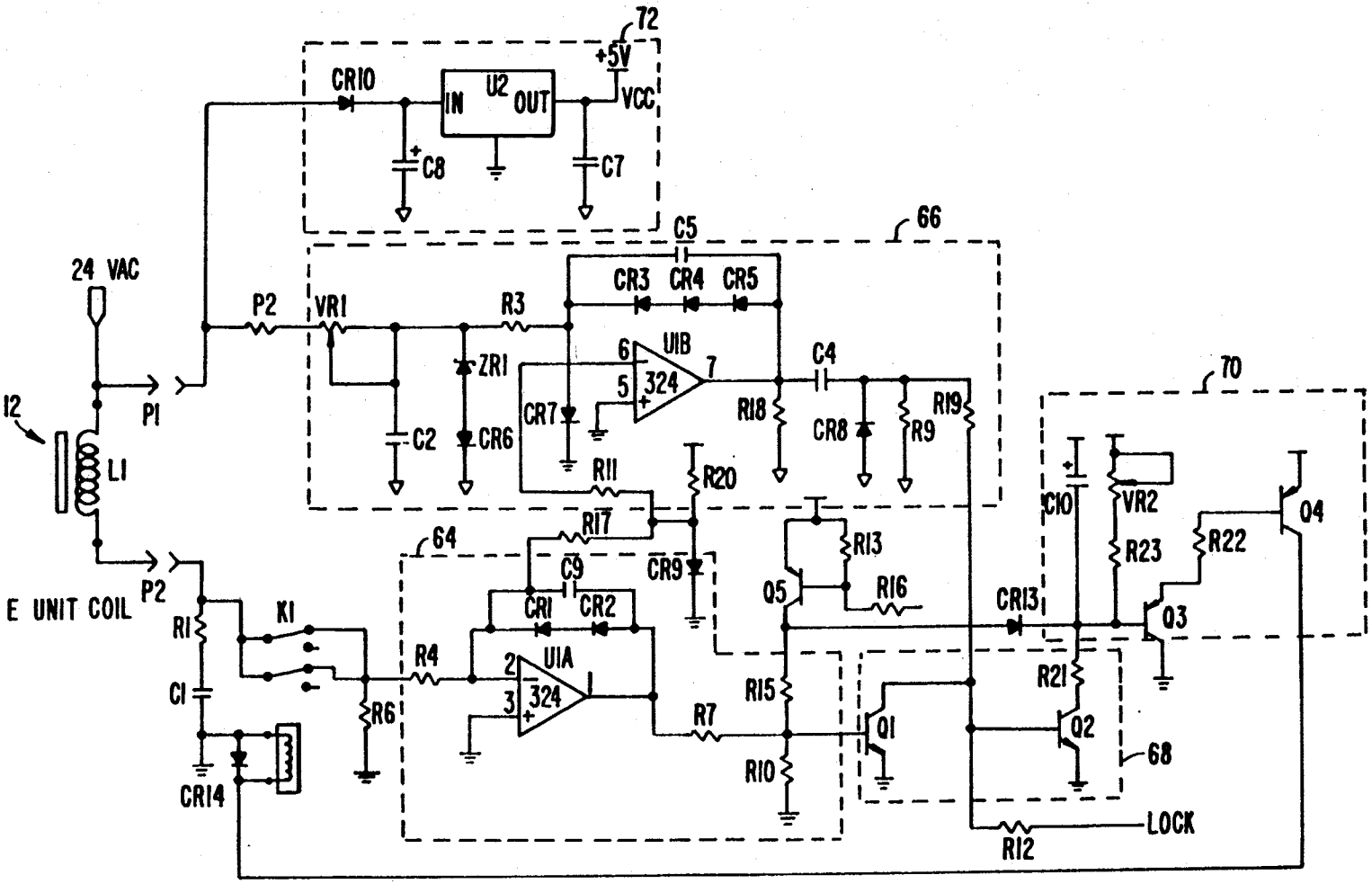
FIG. 5 is a circuit diagram corresponding to the block diagram of FIG. 3.

FIG. 5 is a detailed circuit diagram of one embodiment of the circuit of FIG. 3. Dotted lines roughly indicate the corresponding blocks to those in FIG. 3. The circuit of FIG. 5 solves the problems with the E-Unit discussed in the background, as well as maintaining compatibility with Lionel products.

In attempting to solve the above problems all of the following criteria must be met in order to remain compatible with Lionel products, as well as those of others: 1) the power applied to the trackage varies from approximately 4 VAC to 24 VAC. The lower voltage is called a holding voltage in that it is enough to maintain the state of the E-Unit but is not enough for the train motor to operate; hence a train can stand still and maintain its present directional state. 2) Another problem is the application of non-sinusoidal waveforms to the system. A product has been introduced known as Lion Pack which performs speed control by variance of the AC duty cycle by so-called phase controlled triac methods, not unlike the circuit used in common lamp dimmers. Since the peak amplitude of the AC waveform does not vary a great deal over the operational range, it is difficult to sense changes in applied power. This minimizes the attraction of using amplitude sensing as a solution in non-sinusoidal systems. 3) A third parameter to be met is Lionel's standard for applying a DC offset to the AC power to operate a horn, whistle or bell. Other parties have also introduced accessories which respond to this DC offset. Some are sensitive to polarity, some are not. 4) A fourth parameter which must be met is proper operation of the system in the region of 4 to 6 applied AC volts. Any circuit addressing this region of operation must maintain the separation of E-Unit and motor response to retain standard operation. 5) A fifth requirement is the response time of the system. Two response times are germane: the response time when power is first applied, and secondly the response to brief power outages due to dirty track and loose connections. One preferred design applies power immediately to the E-Unit and yet is insensitive to power interruptions of 150 milliseconds or less.

In FIG. 5, a circuit is shown that addresses all of the above requirements. The circuit monitors the respective voltage and current phases applied to the E-Unit coil, L1. By making a determination of the relative phase relationship between voltage and current within the coil, the condition of a bottomed-out plunger can be detected. This is possible due to the effect the plunger has upon the solenoid coil by changing its inductive properties relative to its position inside the coil.

The circuit in FIG. 5 senses said phase relationships and acts upon them to eliminate the above stated problems in the E-Unit. Comparator U1A and its supporting circuitry provide for a current phase detector; circuit element U1B and supporting components supply the necessary voltage phase detection. The voltage phase is chosen as the reference phase; comparisons are then made with respect to the current and voltage phases. Relay K1 provides an AC path for L1 power to AC common through its normally closed contacts. K1, in the energized state, removes power from L1 and current sensing resistor R6. In the K1 energized state solenoid coil L1 will not have a current path to AC common and will therefore be quiet since no current can flow. K1 will remain energized in the absence of current flowing through K1 contacts and R6 to AC common. When track power is removed, K1 will relax after a period of time set by C10 in capacitive hold circuit 70 and C8 in voltage regulator circuit 72. Upon reapplication of power K1 will re-energize only upon seating or bottoming of the plunger in solenoid L1. This provides a means for a momentary pulse of power to L1, thereby effecting a change of directional state in the standard Lionel method.

R1, C1 acts as a snubber network for protection of the relay contacts from emf generated by the inductive elements in the circuit, mainly L1. CR14 is a spike cancelling element to limit inductive spikes generated by K1's coil. R6 is a current sense resistor, across which a voltage is developed by current flowing through it from coil L1 via K1 contacts. The developed voltage is applied to the U1A inverting input through R4 which isolates the feedback path, CR1, CR2, C9 from the low impedance of R6.

In this state, the U1A output voltage will swing positive when the applied AC voltage is negative. The maximum voltage allowed at the output of U1A is 1.2 volts, set by diodes CR1 and CR2. Capacitor C9 limits the overall frequency response of the element to approximately 10 Khz for noise considerations. The resulting wave shape is a square wave whose period is equal to one-half the applied AC frequency of 60 Hz or 8.33 ms maximum. The U1A output is then applied to the base of Q1 through R7, thereby biasing Q1 ON during positive output periods of U1A. When Q1 is turned ON its collector is less than 0.6 volts above AC common thereby holding Q2 in the OFF state. This inhibits Q2 which normally turns ON during the reference pulse of approximately 1 ms generated by U1B and the absence of the 8 ms signal from U1A. Q2 in the ON state pulls the Q3 base low through R21, thereby turning ON Q4. Q4 provides a DC path from the 5 volt supply to K1, thereby energizing K1. Upon K1 being energized, the AC path for coil L1 (E-Unit) is broken, de-energizing L1, allowing L1 to relax awaiting the reapplication of power effecting a change in directional state. With L1 deenergized, and hence no current flowing through K1 contacts and R6, U1A no longer generates a pulse and the voltage reference pulse is free to turn Q2 ON, keeping K1 energized through Q4 and L1 OFF, eliminating the noise. C10 functions to keep Q3 ON during the absence of a pulse for a time period set by C10, VR2, R23. R22 limits current in Q3, Q4.

The other main element is U1B which has an input signal applied to its inverting input through an RC network, comprised of R2, VR1 and C2. This network is adjustable to provide the optimum point, phase wise, for U1B to trigger. ZR1 creates a negative DC offset on amplitudes greater than 5.7 vac across C2. This provides for an earlier trigger point for U1B to compensate for the effects of core saturation in L1 at voltage levels above 12 vac. CR6 prevents ZR1 from conducting on negative half-cycles. R3 limits loading on the RC network. CR7 clamps the applied voltage in the positive direction to prevent a positive DC offset on C2, through R3, without which U1B would be biased off, resulting in loss of the reference pulse. CR3, CR4, and CR5 operate in the same fashion as CR1 and CR2, as does C5 and C9. The U1B output couples to the Q2 base via C4, R19 which act as a differentiator on the output pulse generated by U1B. This is necessary to ensure a sufficiently short pulse is applied to the base of Q2 which can be masked by the output of U1A, when present, over a broad enough range to ensure operation in systems using phase-controlled triac power. R9 and R18 serve as bleed paths to C4; CR8 dumps charge developed on C4 on negative voltage swings which would otherwise inhibit proper operation.

It is important to note that the output pulse duration of U1A is proportional to the negative zero-crossing interval of the applied AC wave at its input. While this value is fixed at 8.33 milliseconds for sinusoidal inputs, it varies for nonsine inputs. Therefore, if a non-sinusoidal AC wave is applied to the input, such as a phase controlled triac circuit (e.g., a light dimmer circuit) a consideration arises in that the current phase monitor's ability to mask the 1 ms voltage circuit pulse is diminished since the duration of the U1A output pulse varies directly with the input, keeping in mind that the current pulse shifts in phase relative to the reference voltage pulse.

Other circuit elements are Q5, R13, R16, R15 and CR13 which comprise an external means to cycle the E-Unit without the normally required loss of power in the standard system. This has the obvious advantage of providing a port for control by logical elements and the like. R12 serves as an external control port which enables the locking of the E-Unit in the present directional state. Likewise, the collector of Q4 provides a point to indicate when an E-Unit cycle has been completed. R20, CR9 provide a DC bias set point for both U1A and U1B, through R17 and R11, respectively. The purpose is to ensure a stable output in the absence of the applied signal, when a power-down direction command is issued and during the dead band when phase controlled triac power is used. It additionally increases noise immunity of the circuit.

Overall DC potential is provided to the circuit by a supply circuit comprised of CR10, C8, U2 and C7. C8 is necessarily large to keep power across the circuit at times when power interruptions occur.

Figure 6:
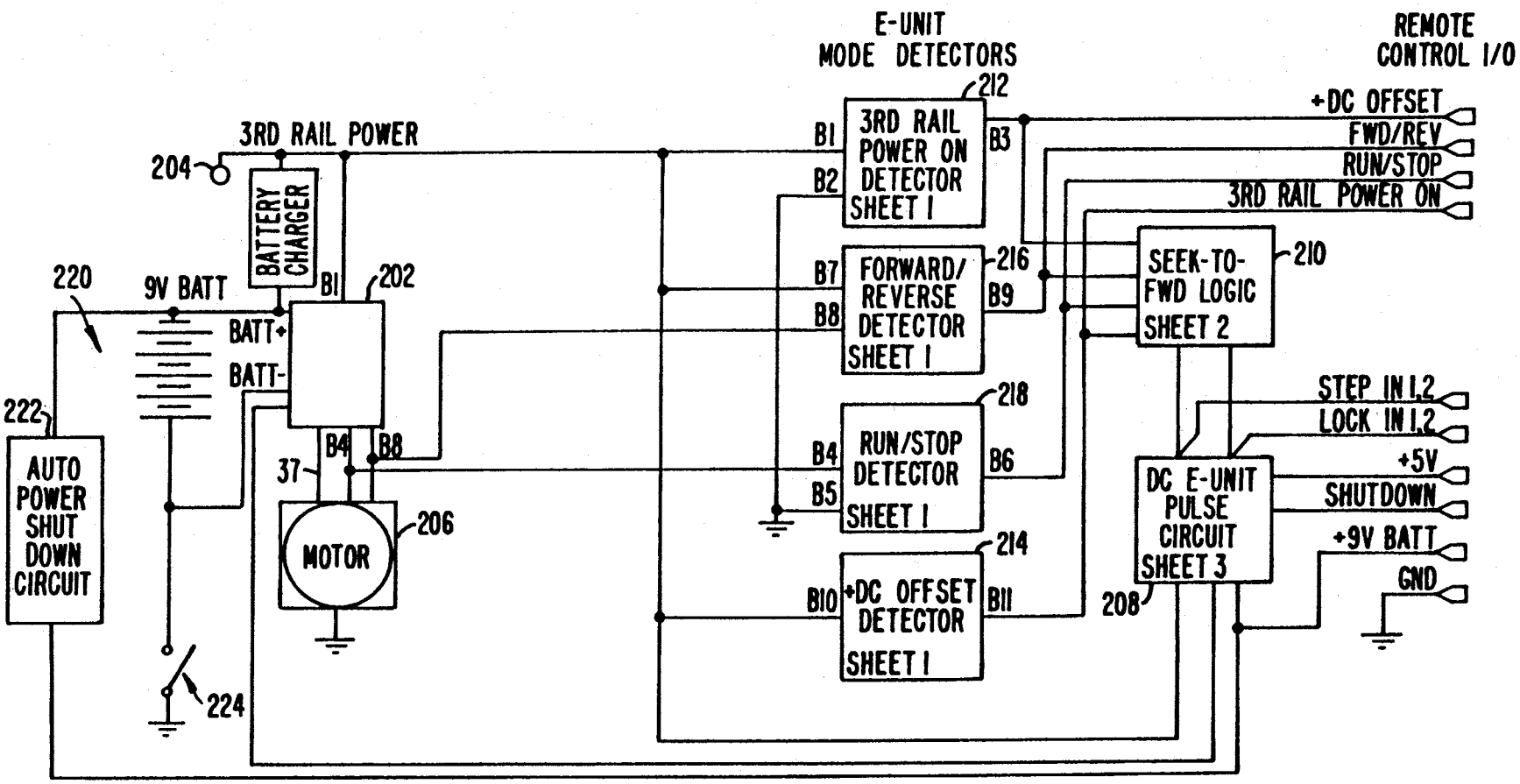
FIG. 6 is a block diagram of an alternate embodiment of an E-Unit controller.

FIG. 6 shows an alternate embodiment of an E-Unit control system. An E-Unit 202 is shown connected to the track rail power 204 and the train motor 206. An E-Unit pulse circuit 208 controls the sequencing of the E-Unit. This is done in response to logic block 210, which receives inputs from four mode detector circuits. A power-on detector circuit 212 indicates if power is applied to the track. A DC offset detector 214 determines whether there is a DC offset on top of the alternating track power signal. The track power and DC offset are controlled by the user.

The remaining two modules determine the condition of the E-Unit. A forward/reverse detector 216 determines whether the E-Unit has placed the motor in forward or reverse. A run/stop detector 218 determines whether the motor is in gear or in neutral.

Battery operation is provided with a 9 volt battery 220, which is connected to an automatic shutdown circuit 222 and a manual shut-off switch 224. Remote control of the system through a microcontroller on the train is provided through the remote control I/O inputs on the right side of FIG. 6. The controller receives its commands via FSK signals provided along the track as discussed later.

Figure 7:
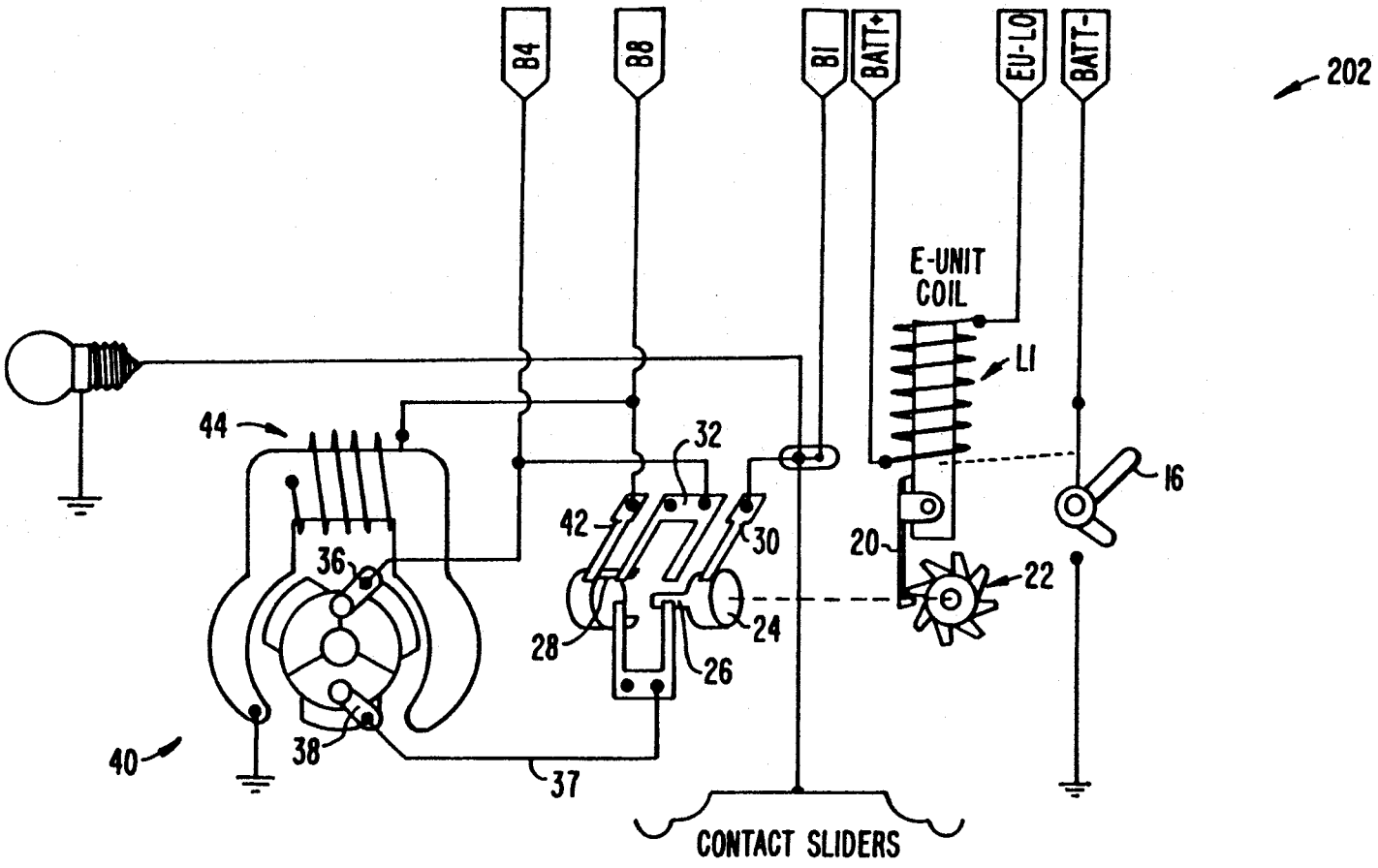
FIG. 7 is a schematic diagram of the E-Unit of FIG. 1 with modified connections for use in the circuit of FIG. 6.

FIG. 7 shows the E-Unit of FIG. 1 with modified connections for use in the system of FIG. 6. The connection between E-Unit switch 16 and E-Unit coil L1 is broken and brought out as the BATT− signal and the EU-LO signal. The connection between the E-Unit coil and contact 34 for the E-Unit drum is also broken and brought out as lines BATT+ and B1. Finally, lines B4 and B8 connecting to the motor field and one of the brushes are brought out for sensing by the forward-/reverse detector 216 and the run/stop detector 218. The break of the E-Unit connection at terminal B1 and BATT+ allows the motor to be powered directly from the rail power through terminal B1. The E-Unit is then controlled by being given power through its connection at EU-LO, with the BATT+ signal providing the path to ground through the battery. The connection of the E-Unit switch 16 (same as 224 of FIG. 6) to the BATT− signal allows the other side of the battery to be disconnected, thereby still providing the E-Unit switch with the capability of turning off the E-Unit.

Figure 8:
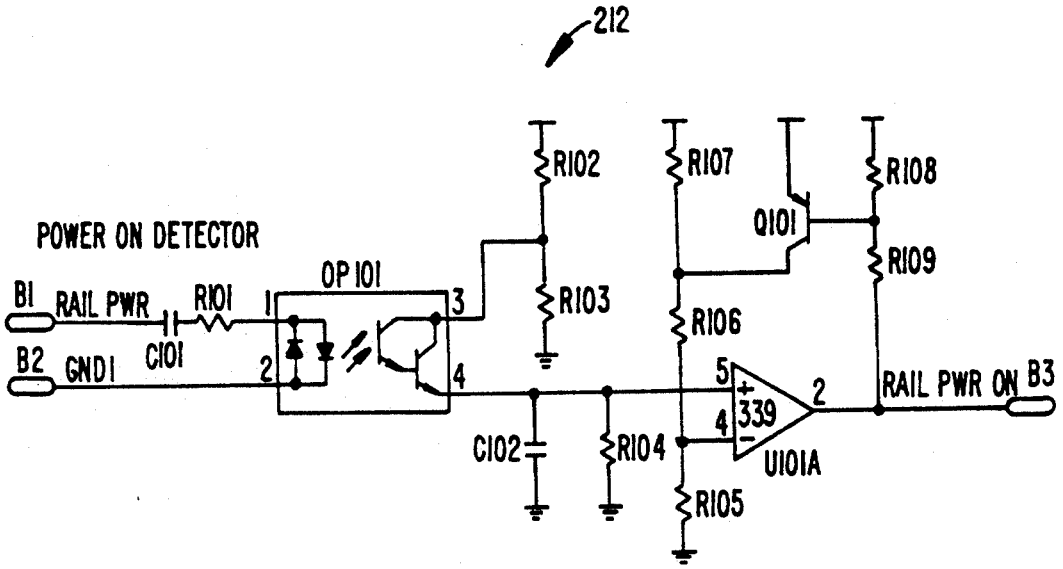
FIG. 8 is a circuit diagram of the power on detector block of FIG. 6.

FIG. 8 is a circuit diagram of power-on detector 212 of FIG. 6. Input terminals B1 and B2 connect between the track rail power and ground through an optically isolated coupler OP 101. The output of the amplifier OP 101 is provided to a comparator U101A and associated circuitry. The output on line B3 is provided to logic block 210 of FIG. 6 and the I/O interface.

Figure 9:
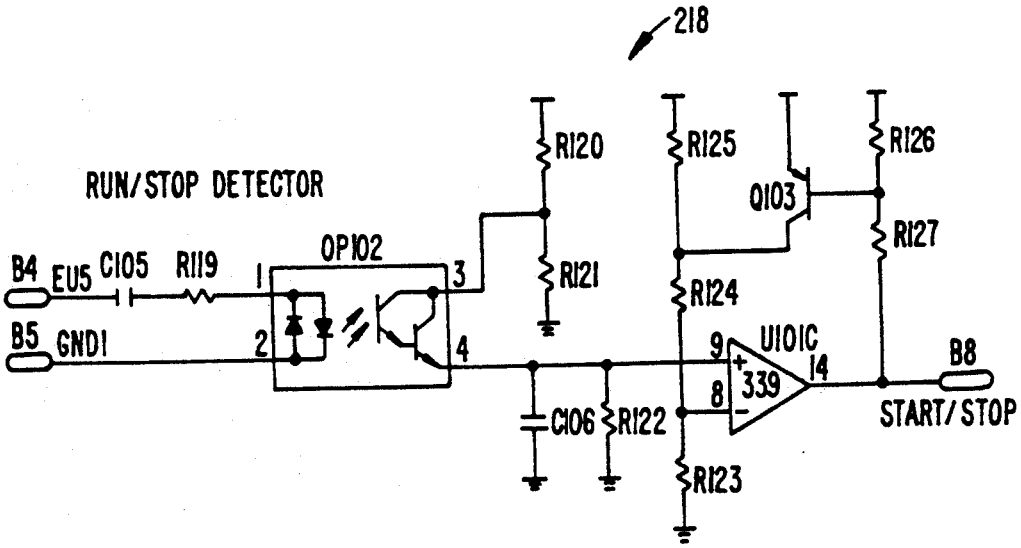
FIG. 9 is a circuit diagram of the run/stop detector block of FIG. 6.

FIG. 9 is a circuit diagram of run/stop detector 218 of FIG. 6. Input pin B5 is connected to ground, and B4 is connected to the motor brush output of the E-Unit (see FIG. 7) which will have a high value when the E-Unit is in either forward or reverse, and a low value otherwise. Thus a high value at output pin B6 indicates that the motor is in gear. The inputs are provided through an optically isolated coupler OP102, and from there through a comparator U101C and associated circuitry. The output on line B6 is provided to logic block 210 and to the I/O interface of FIG. 6.

Figure 10:
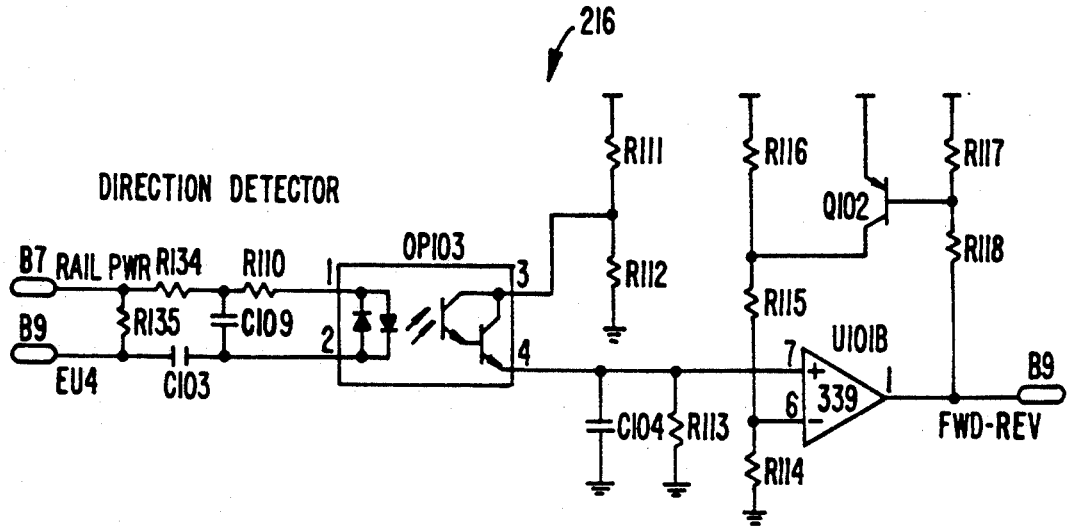
FIG. 10 is a circuit diagram of the forward/reverse detector block of FIG. 6.

FIG. 10 is a circuit diagram of direction detector 216 of FIG. 6. The inputs on lines B7 and B8 are connected between the rail power and line B8 of the E-Unit which is connected to the motor field winding. The inputs are provided through an optically isolated coupler OP103, and from there to a comparator U101B and associated circuitry. The output of line B9 is provided to logic block 210 and the I/O interface of FIG. 6.

Figure 11:
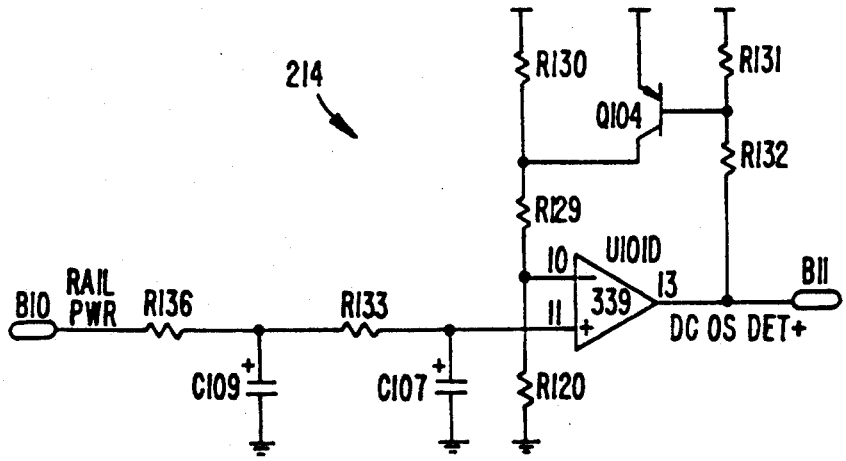
FIG. 11 is a circuit diagram of the DC offset detector block of FIG. 6.

FIG. 11 is a circuit diagram of a positive DC offset detector 214 of FIG. 6. Input B10 is from the rail power, and a signal is provided at the output of a comparator U101D on line B11 when there is rail power. This signal is provided through logic block 210 and the I/O interface of FIG. 6.

Figure 12:
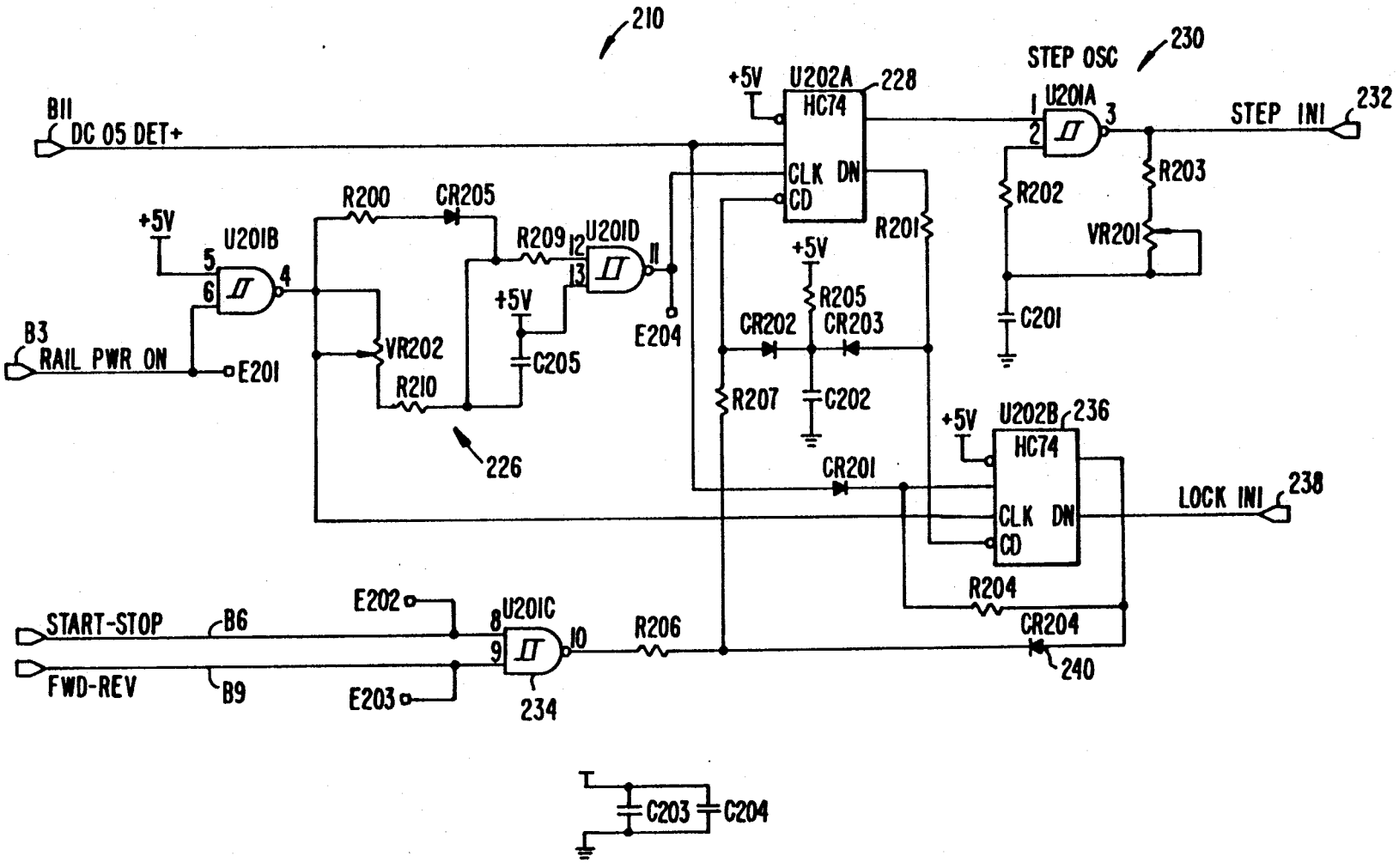
FIG. 12 is a circuit diagram of the seek-to-forward control block of FIG. 6.

FIG. 12 is a circuit diagram of seek-to-forward logic block 210 of FIG. 6. The E-Unit pulse circuit 208 shown in FIG. 13 allows the E-Unit to be cycled through its positions by applying and removing rail power as discussed below with respect to FIG. 13. The circuit of FIG. 12 provides a feature of controlling the pulse circuit of FIG. 13 so that it will cycle automatically to the forward position no matter what position it is in. This is accomplished by first pushing the whistle button, to impose a DC offset on the rail power and then increasing rail power. The "rail power on" signal on line B3 from power on detector 212 is applied through a logic circuit 226 to the clock input of a flip-flop 28. The DC offset signal on line B11 from offset detector 214 is applied to the D input of flip-flop 228. This will cause an output of flip-flop 228 to activate a step oscillator circuit 230. The output of step oscillator 230 on line 232 is provided to the E-Unit pulse circuit of FIG. 13.

Feedbacks are provided from the run/stop signal on line B6 and the forward/reverse signal on line B9. When both these signals are high the motor is in forward and the output of a NAND gate 234 will clear flip-flop 228 through its clear input. The forward-/reverse signal cannot be used alone because a false signal might be generated without power applied to the track.

The train motor can be locked into forward gear by lowering the rail power signal to provide a high input on line B3, while applying a DC offset. This provides a signal to the clock input of flip-flop 236, which provides a lock output on line 238 to E-Unit pulse circuit 208 of FIG. 13. An output of flip-flop 238 is also provided through a diode 240 to the clear input of flip-flop 228. Diode 240 acts to give an AND connection of the flip-flop output with the NAND gate 234 output. To remove the lock condition, the seek-forward control is activated.

Figure 13:
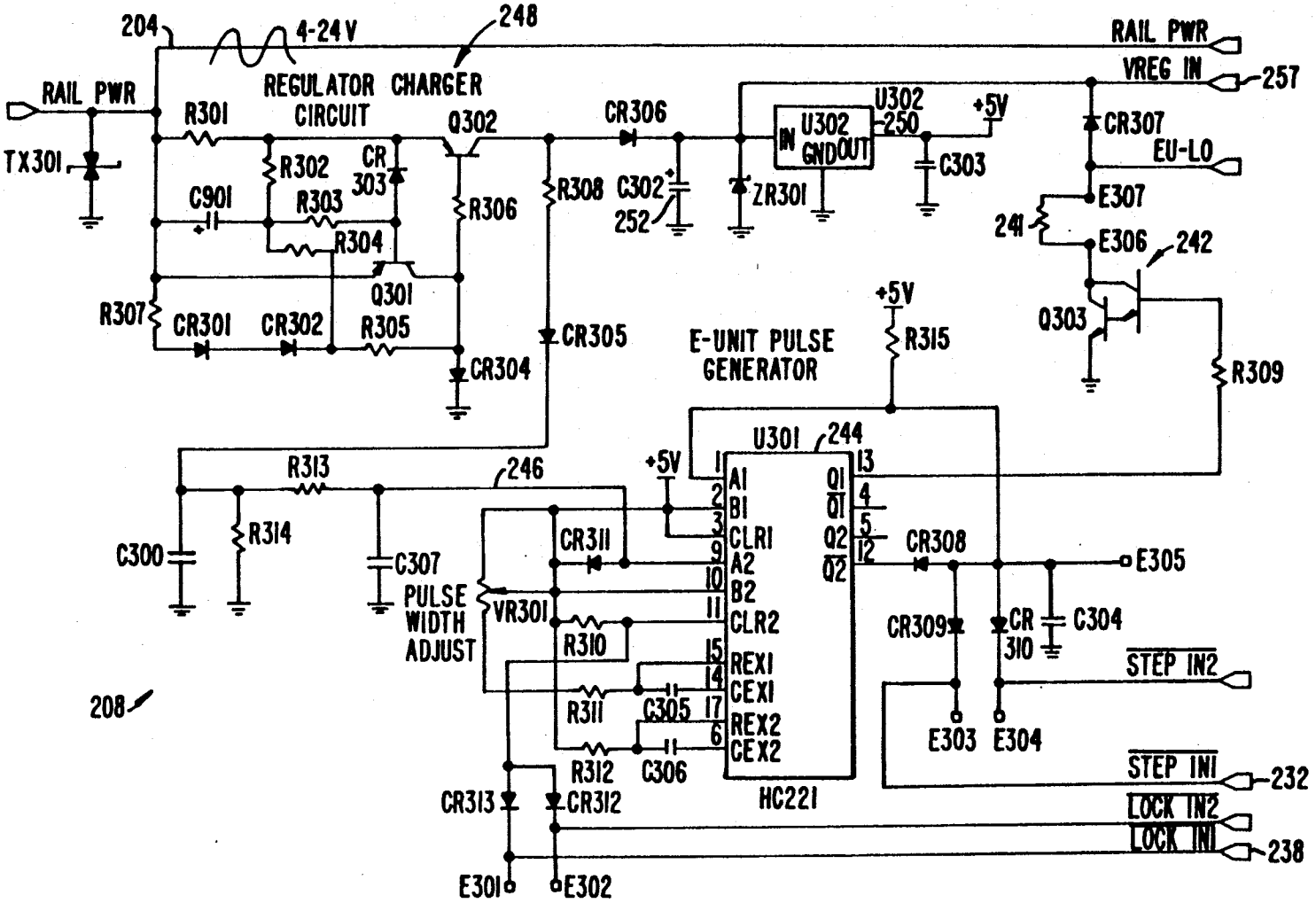
FIG. 13 is a circuit diagram of the DC E-Unit pulse control circuit of FIG. 6.

FIG. 13 is a circuit diagram of E-Unit pulse circuit 208 of FIG. 6. This is a DC operated version similar to the AC version of FIG. 5. In the FIG. 5 circuit, AC is applied across the E-Unit coil, while in this embodiment, DC is applied to the E-Unit coil. This DC version eliminates the large capacitor C8 and relay K1. The DC version adds a battery not needed in the AC version. The output to the E-Unit is line EU-LO. Current will flow through the E-Unit when Darlington transistors 242 are turned on by a high-going pulse from the output of nonretriggerable one-shot 244. One-shot 244 receives an enabling input on line 246 which is provided from a regulator/charger circuit 248.

When rail power is removed, line 204 will go low, causing loss of power to the regulator/charger circuit 248 and line 246 as an input to one-shot 244 to go low. Line 246 is connected to an active low input of the one-shot, triggering the one-shot to provide a high-going pulse to Darlington pair 242, turning on the E-Unit long enough to cause it to cycle. When the pulse disappears, the E-Unit will be turned off again. The Darlington pair effectively shorts the EU-LO connection to ground except when it is turned off by a low pulse at its base. An optional resistor 241 is used to adjust the voltage level to match the characteristics of a particular E-Unit.

A number of inputs are provided for a remote control I/O in the form of the step and lock signals on the lower right of the figure. The step signals each can trigger the one-shot to cause the E-Unit to step to another state. The lock signals each can lock the E-Unit in a particular state by disabling further pulses from the one-shot. Step and lock lines 232 and 238 are connected to seek-to-forward logic 210.

FIG. 13 also includes a voltage regulator 250 which provides the 5 volts supplied to the electronics. In the event of loss of rail power for a longer period of time than can be supplied by capacitor 252, a battery input line 254 will provide the necessary power.

Figure 14:
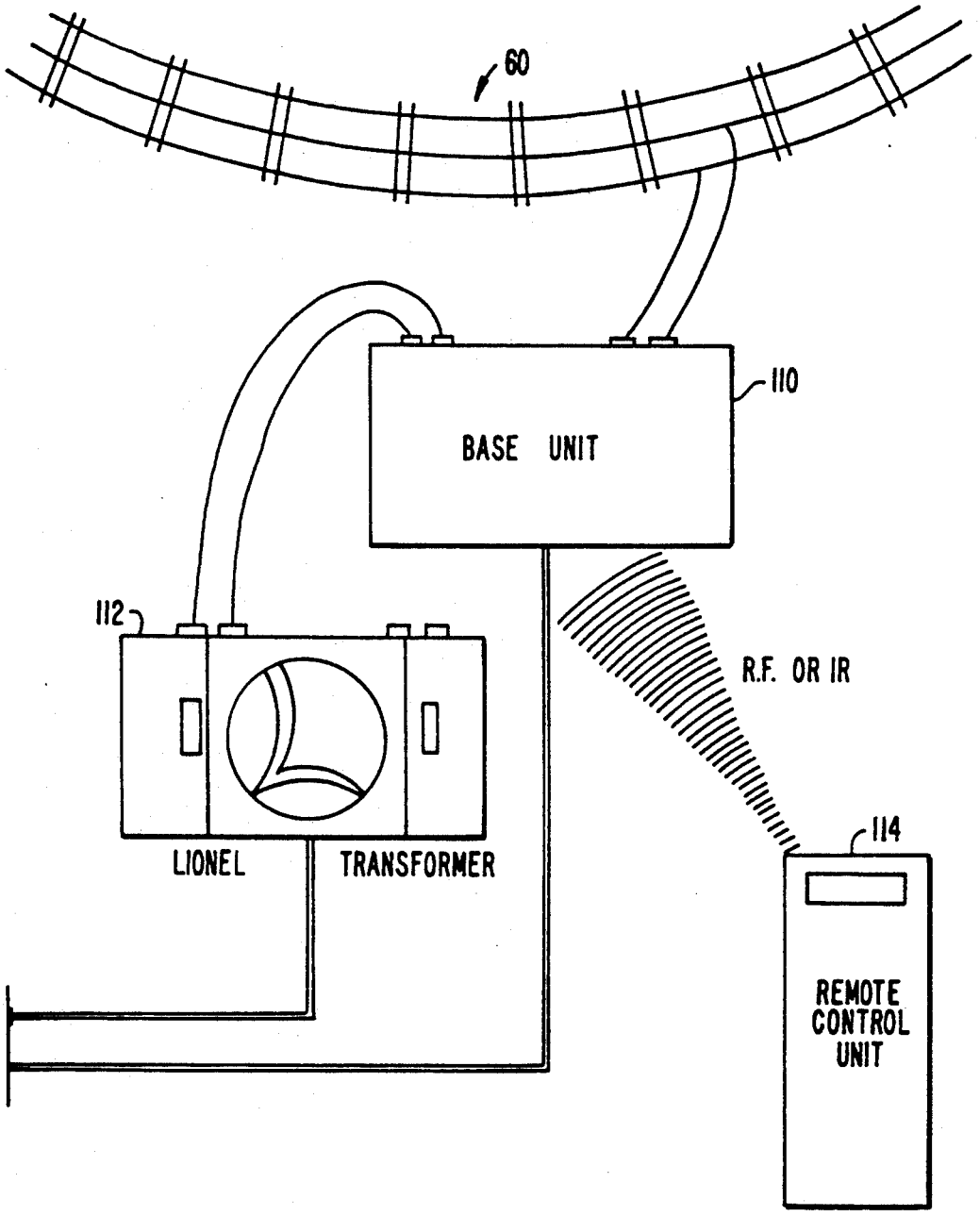
FIG. 14 is a block diagram of the transmitter and base unit of the present invention.

FIG. 14 shows a block diagram of the controls connected to the tracks 60. A base unit 110 is connected between the tracks and a standard Lionel transformer 112. A remote control unit 114 transmits radio frequency, infrared or other signals to base unit 110. Base unit 110 combines an FSK signal with the power signal applied to track 60 to send an address and data signal to a power block of the track. The addressed train on that power block will receive and decode the signal.

Figure 15:
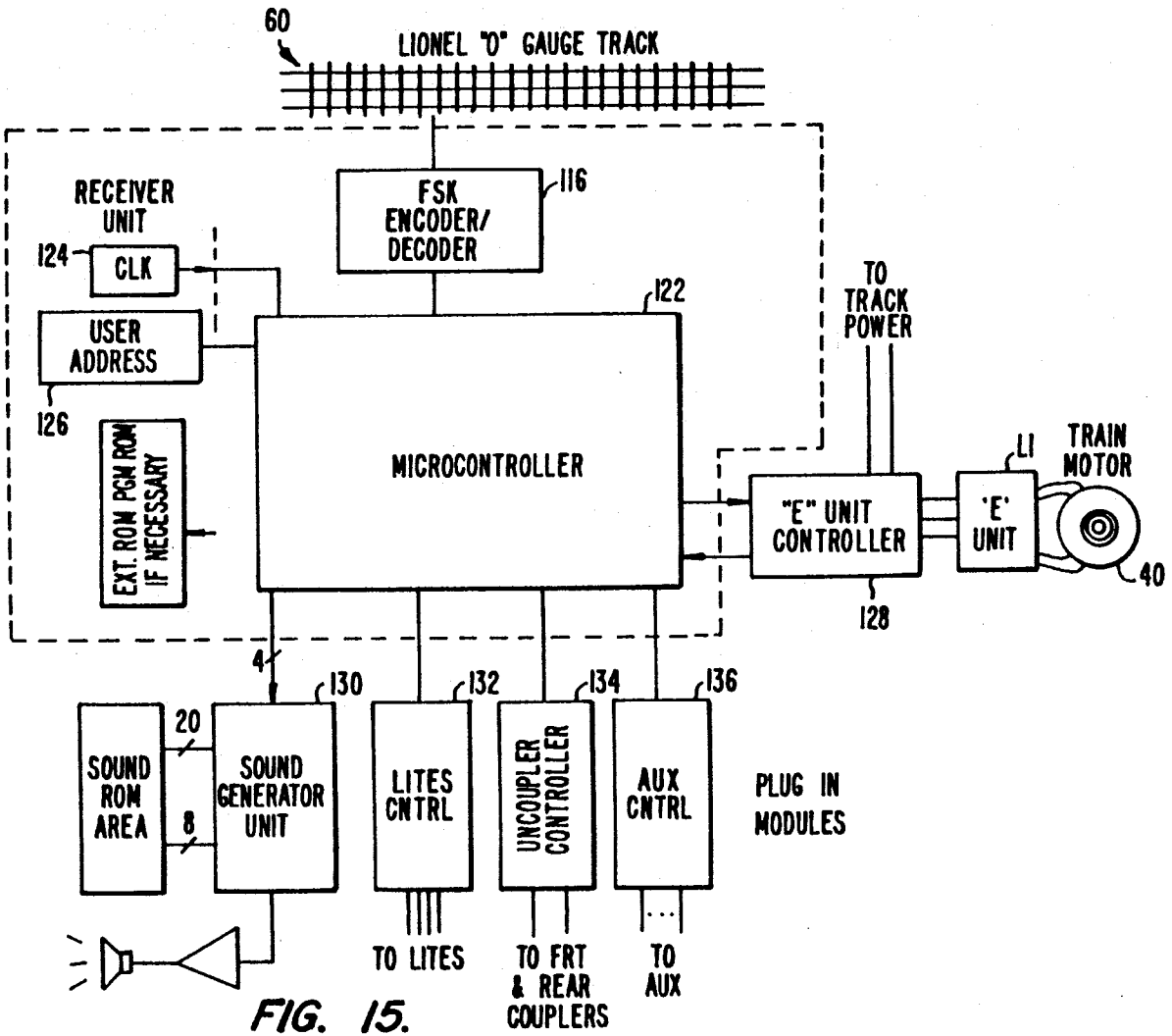
FIG. 15 is a block diagram of the receiver control unit in an individual locomotive.

Each train engine includes a receiver of the form shown in the diagram of FIG. 15. The receiver has an FSK encoder and decoder 116 coupled to track 60. The encoder/decoder includes filtering and error detection/correction circuitry. The encoder/decoder is coupled to a microcontroller 122. Microcontroller 122 receives the clock input from a clock 124 and is provided with a user address 126. The controller is connected to an E-Unit controller 128, such as that shown in FIGS. 3 and 5 or the embodiment of FIG. 6. This is in turn connected to E-Unit L1 and motor 40.

The connections to the E-Unit controller 128 provide the recycle signal shown in FIG. 5 or the step signal of FIG. 6, along with the lock signal. This allows the microcontroller to control the operation of the E-Unit controller.

The microcontroller 122 also can control a number of options such as sound generator unit 130, a light controller 132, an uncoupler controller 134 and other auxiliary functions 136.

Figure 16:
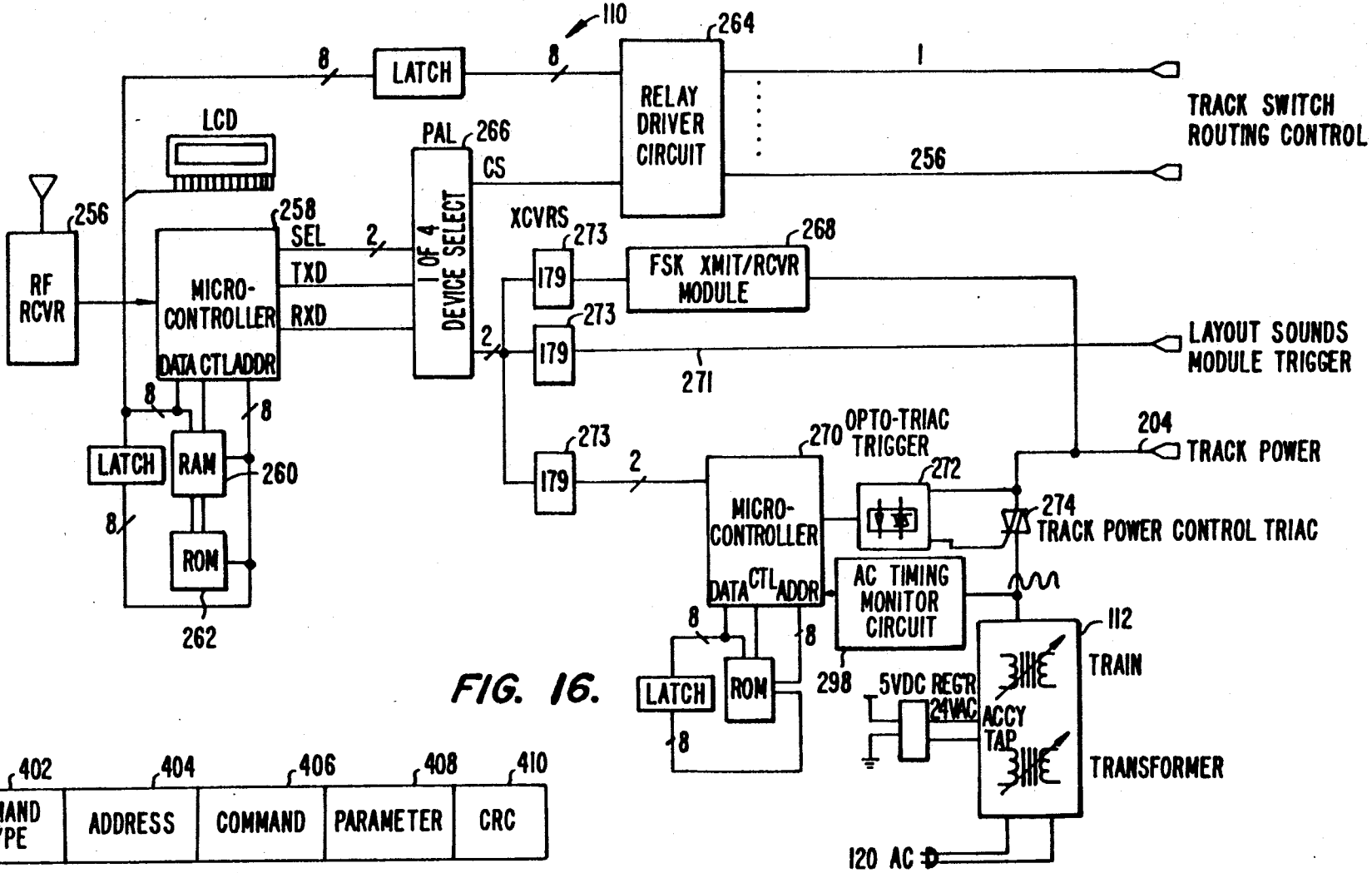
FIG. 16 is a block diagram of the base unit of FIG. 14.

FIG. 16 is a block diagram of the components of base unit 110 of FIG. 14. A receiver 256 receives signals (via RF, IR or other methods) from remote control unit 14 of FIG. 14. These signals are provided to a microcontroller 258 which has its associated RAM 260 and ROM 262. The controller provides data outputs to a relay driver circuit 264 which controls the switches at various points on the track layout to set up the track in the desired arrangement.

The microcontroller also provides control signals to the trains through a programmable array logic chip 266 and an FSK transmit/receive module 268. Module 268 provides coded signals in FSK to be combined with the track power signal on line 204.

Microcontroller 258 also allows the remote user to control a separate microcontroller 270 which uses an optical trigger 272 to control a triac switch 274. The triac switch can be manipulated to switch the AC waveform from transformer 112 at appropriate times to control the AC power level and impose a DC offset.

Microcontroller 258 also allows the remote user to control sound modules placed throughout the train layout via lines 271. Lines 271, FSK module 268 and microcontroller 270 are connected together through transceivers 273 to a common RS 485 line to a device select PAL 266.

Figure 16A:
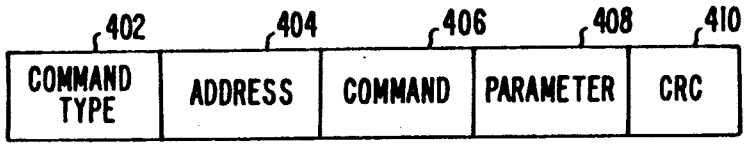
FIG. 16A is a diagram of the protocol used by the circuit of FIG. 16.

FIG. 16A shows the protocol used by the system of FIG. 16. A message received by the RF receiver 256 and provided to microcontroller 258 will have the fields set forth in 16A. A command-type field 402 identifies the type of command. For example, a first command-type would be for the sounds modules and will be directed to lines 271. A second command-type would be for a transmission to the trains and would be directed to FSK module 268. Alternately, commands can be directed to the track switching relay driver circuit 264 or the power control microcontroller 270. The second field 404 sets forth the address. For example, if the command is for the trains, the address will set forth a particular train to which it is to be directed. Alternately, for the layout sounds command, it will designate which of the remote sound modules is to be activated.

The next field 406 is the command itself. For example, it might say to increase the track power or activate a certain sound module. The following parameter field 408 would then indicate the parameters of the command, such as the level to which power to the track is to be increased or the amount or frequency of the sound to be generated. The last field contains a cyclic redundancy code (CRC) 410 which is used for error checking.

The use of the same protocol of FIG. 16A throughout the system of FIG. 16 allows for the distributed processing accomplished in the system of FIG. 16. Each control node can look at the different fields of the protocol. For instance, microcontroller 258 will direct the message according to the command-type 402. FSK module 268 will direct the command according to the address, and the trains on the track will receive it in accordance with the address, and then decode it for the command parameter.

Figure 17:
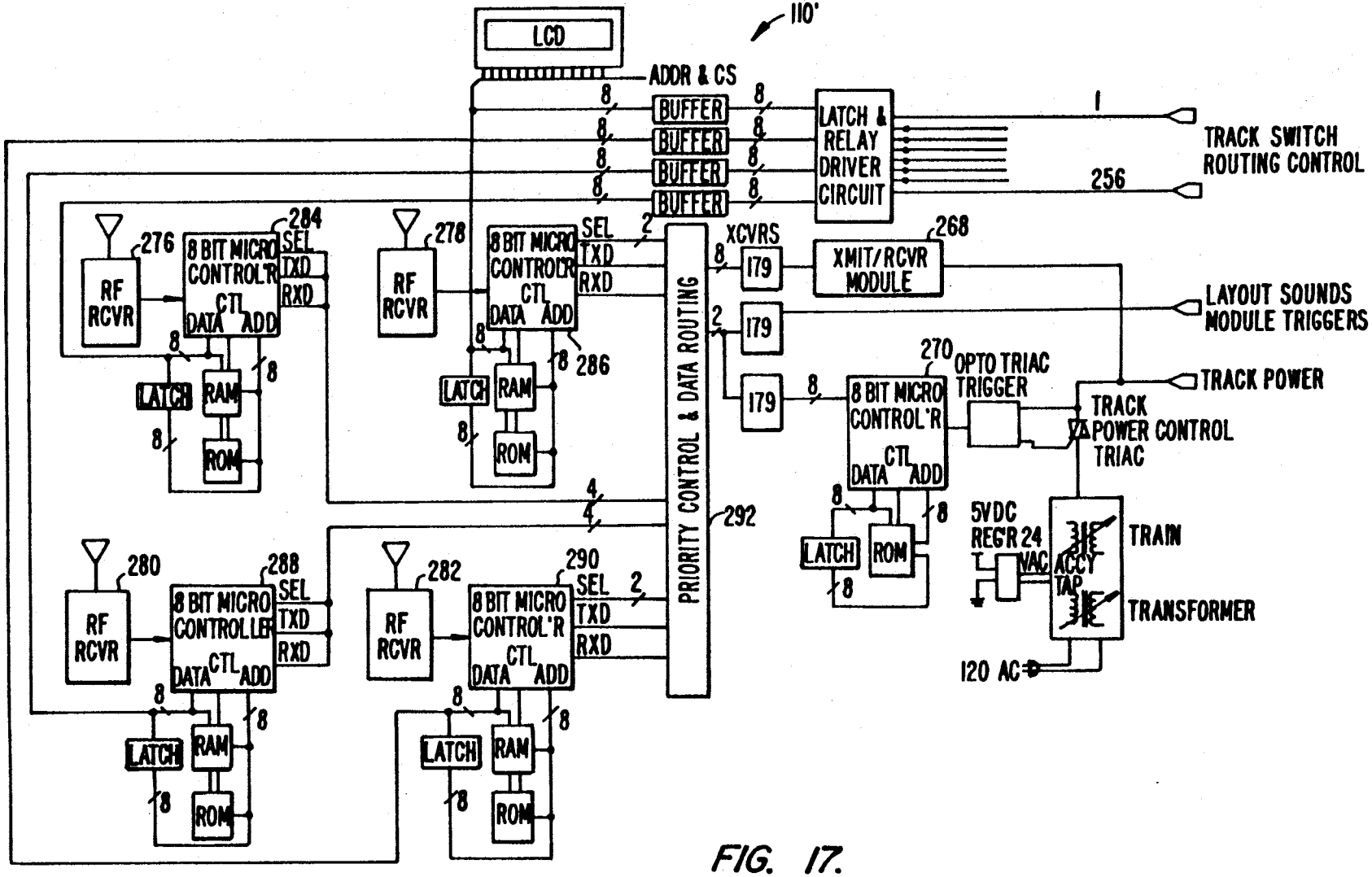
FIG. 17 is an alternate embodiment of the base unit of FIG. 16 with multiple receivers.

FIG. 17 shows an alternate embodiment of a base unit 110' which includes four receivers 276, 278, 280 and 282. Each has its associated controller 284, 286, 288, and 290. These are all connected through a priority control and data routing logic circuit 292 which connects them to the FSK module 268 and the AC level and DC offset controller 270. With this arrangement, four separate remote control units can be used to control trains on the same power block of a track through the same base unit.

Figure 18A:
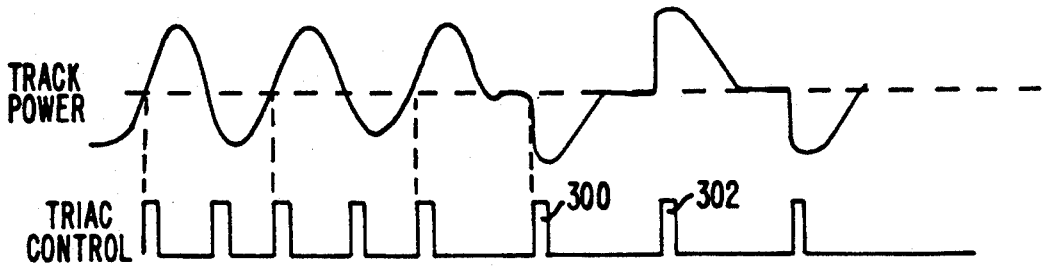
FIGS. 18A-C are diagrams of waveforms through the power triac of FIG. 16.

FIG. 18A illustrates the track power signal on line 204 of FIG. 16 as it is controlled by the triac. The triac control pulses are shown immediately below. In order to allow remote control of the power applied to the track, and thus the speed of the trains, transformer 112 is set to a maximum desired level. The waveform is then modulated by the triac under the control of microcontroller 270, which is in turn controlled by microcontroller 258 which operates under the user control from the remote. As can be seen, in the first part of FIG. 18A, full power is applied to the track. This is accomplished by pulsing the triac at each zero crossing of the power signal to turn the triac on in the positive or negative going direction, respectively. The microcontroller knows when to pulse the triac by monitoring the power supply provided from the transformer through a monitoring circuit 298 of FIG. 16. When it is desired to decrease the power applied to the track, the pulses are simply applied after the zero crossing. When the AC signal crosses zero, it automatically shuts off, bringing its value to zero, until it is pulsed by the triac. Thus, when the triac control is first varied, the signal goes to zero and until it is pulsed by a triac pulse 300. Subsequently, the positive going triac pulse is also delayed to a time 302, thus cutting the amount of the positive part of the waveform as well. The power applied is equal to the area under the curves, which is cut almost in half in the diagram shown in FIG. 18A. By appropriately varying the timing, the power applied to the track can be controlled.

Figure 18B:
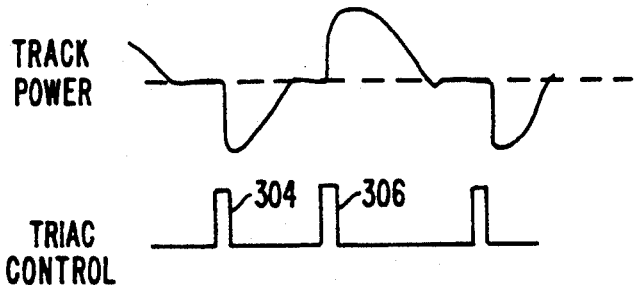
Figure 18C:
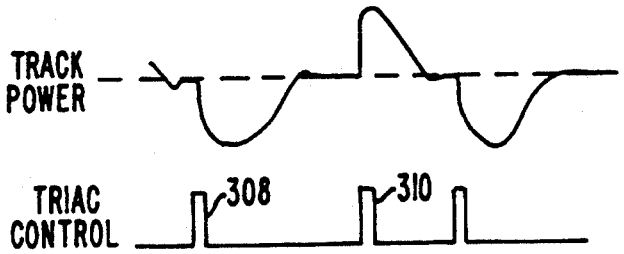

In addition, a DC offset can be applied to the track by appropriately controlling the triac. As could be seen in FIG. 18A, the triac control pulses were equally spaced so that the positive and negative pulses would be even. By varying the phase, such as shown in FIG. 18A, an offset can be generated. As can be seen in FIG. 18B, a pulse 304 occurs relatively late after the negative going zero crossing, giving a small negative waveform. On the other hand, a pulse 306 occurs shortly after the positive going zero crossing, thus only clipping a small portion of the positive going waveform. This gives an overall DC offset when the values are averaged. This DC offset is detected by circuitry in the train itself. As can be seen, the triac pulses of FIG. 18B do double duty. They not only impose a DC offset, but also control the AC track power signal. The delay of the pulse after the zero crossing controls the track power while the differential between the negative going and positive going trigger pulses controls the amount of the DC offset. Evenly spaced pulses produce zero DC offset.

Similarly, FIG. 18B illustrates the imposition of a negative DC offset. A pulse 308 occurs shortly after the negative going zero crossing, while a pulse 310 occurs a longer time after a positive going zero crossing. This results in a net negative DC offset.

By appropriately controlling the track power, a DC offset can be imposed without varying the power applied to the train, as required in prior art systems. Since it is the phase variation which causes the DC offset, the total area under the curve can be maintained to preserve the same power to the train. For instance, if a positive DC offset is imposed by clipping less of the positive signal or clipping more of the negative signal, the amount clipped can be controlled so that the total area is still the desired power. The greater amount clipped in a negative region is made up for by less being clipped in the positive region so that the overall power remains the same. This eliminates the annoying effect of having the train slow down when a DC offset is attempted to be applied to control the whistle or other effects on the train.

A complex train track layout can have several power blocks, with the borders between power blocks delineated by insulator pins in the tracks. These separate power blocks can be separately controlled using the single base unit of this invention. Separate versions of microcontroller 270 and triac switch 274 of FIG. 16 can be connected to PAL 266 through additional RS485 transceivers 273 (The transceivers allow communication in both directions, with an acknowledgement being a common transmission returned to the base unit). Each triac could be connected to the same transformer (or its own transformer), and would separately control its power block independently of the other power blocks. The control signals could come from a single remote unit or from different remote units using the configuration of FIG. 17. Alternately, a single microcontroller 270 would control multiple triac switches which control different power blocks.

As will be understood by those familiar with the art, the present invention can be embodied in other specific forms without departing from the spirit or essential characteristics thereof. For example, any number of means could be used to detect the position of the E-Unit plunger, such as a mechanical contact, optical or proximity detection, magnetic detection, etc. Accordingly, the disclosure of the preferred embodiment of the invention is intended to be illustrative, but not limiting, of the scope of the invention which is set forth in the following claims.

What is claimed is:

1. A control system for model trains on a train track system comprising:

a hand-held remote control unit for transmitting control signals;

a transformer for applying track power to said track;

a base unit, connected between said transformer and said track, for receiving said control signals, and combining said control signals with said power on said track;

a train receiver unit, mounted in one of said model trains, for receiving said control signals, and directing the operation of said one model train in response to said control signals.

2. The control system of claim 1 wherein said base unit includes a triac switch coupled between said transformer and said track and a triac control circuit having a control input responsive to some of said control signals for switching said triac switch so as to impose an average DC offset on said track power, said track power being an AC signal.

3. The control system of claim 1 wherein said base unit includes switching means for periodically interrupting said track power from said transformer to thereby vary a power level of said track power as applied to said tracks.

4. The control system of claim 3 wherein said switching means asymmetrically interrupts said track power to give said track power an average DC offset.

5. A control system for model trains on a train track system comprising:

a hand-held remote control unit for transmitting control signals;

a transformer for applying AC track power to said track;

a base unit, connected between said transformer and said track, said base unit including a receiver for receiving said control signals, a first controller, coupled to said receiver, for interpreting said control signals and providing digital output signals, a driver circuit, coupled to said first controller and responsive to a first set of said digital output signals for providing track switching signals to switches coupled to said track, a frequency shift keyed (FSK) transmitter, coupled between said first controller and said track, and responsive to a second set of said digital output signals, for providing FSK signals to said track, switching means, coupled between said transformer and said track, for varying said track power, and a second controller, coupled between said first controller and said switching means, and responsive to a third set of said digital output signals, for controlling said switching means to vary said AC track power and impose a DC offset on said AC track power in response to said third set of digital output signals; and a train receiver unit, mounted in one of said model trains, for receiving said FSK signals, and directing the operation of said one model train in response to said FSK signals.

6. A control system for a model train track system comprising:

a hand-held remote control unit for transmitting control signals;

a transformer for applying AC track power to said track; and a base unit, connected between said transformer and said track, said base unit including a receiver for receiving said control signals, switching means, coupled between said transformer and said track, for varying said track power, and a controller, coupled between said receiver and said switching means, and responsive to said control signals, for controlling said switching means to vary said AC track power and impose a DC offset on said AC track power.

7. A distributed processing control system for a model train track system comprising:

a remote control unit for transmitting control signals, said control signals including a command type field, an address field, and a command field; and a base unit, connected to said track, said base unit including a receiver for receiving said control signals, a plurality of controlling circuits for providing commands to different components of said train track system, each of said controlling circuits responding to a different command type to propagate said control signal to components coupled to that controlling circuit.

8. The control system of claim 7 wherein said remote control unit is a hand-held unit which transmits said control signals as RF signals.

9. The control system of claim 7 wherein said remote control unit is a hand-held unit which transmits said control signals as IR signals.

* * * * *

US005251856C1

(12) REEXAMINATION CERTIFICATE (4394th)

United States Patent

Young et al.

(10) Number: US 5,251,856 C1

(45) Certificate Issued: Jul. 10, 2001

(54) MODEL TRAIN CONTROLLER FOR REVERSING UNIT

(75) Inventors: Neil P. Young, Redwood City; Richard Davis, Palo Alto, both of CA (US)

(73) Assignee: Liontech Company, Chesterfield, MI (US)

Reexamination Request:
No. 90/005,646, Feb. 25, 2000

Reexamination Certificate for:

| | |
|---|---|
| Patent No.: | **5,251,856** |
| Issued: | **Oct. 12, 1993** |
| Appl. No.: | **07/833,869** |
| Filed: | **Feb. 11, 1992** |

(51) Int. Cl.[7] ..... B61L 7/08; B61L 27/00

(52) U.S. Cl. ..... 246/4; 246/187 A; 246/191; 104/300; 104/302; 340/825.69

(58) Field of Search ..... 246/5; 104/295, 104/297

(56) References Cited

U.S. PATENT DOCUMENTS

| | | | | |
|---|---|---|---|---|
| 2,257,473 | | 9/1941 | McKeige et al. | 104/150 |
| 2,622,542 | | 12/1952 | Bonanno | 104/150 |
| 2,872,879 | | 2/1959 | Vierling | 104/149 |
| 3,024,739 | | 3/1962 | Smith et al. | 104/149 |
| 3,361,082 | | 1/1968 | Leslie | 104/151 |
| 3,555,270 | | 1/1971 | Persson | 246/194 |
| 3,675,586 | | 7/1972 | Haddad | 104/149 |
| 3,736,484 | | 5/1973 | Reynolds et al. | 318/587 |
| 4,062,294 | * | 12/1977 | Cohen | 104/149 |
| 4,207,569 | | 6/1980 | Meyer | 343/6.5 R |
| 4,341,982 | | 7/1982 | Lahti et al. | 318/51 |
| 4,711,418 | * | 12/1987 | Aver et al. | 246/5 |
| 4,747,351 | * | 5/1988 | Baret | 104/297 |
| 5,050,505 | | 9/1991 | Konno | 104/295 |
| 5,085,148 | | 2/1992 | Konno | 104/130 |
| 5,263,670 | | 11/1993 | Colbaugh et al. | 246/63 R |
| 5,448,142 | | 9/1995 | Severson et al. | 318/280 |

FOREIGN PATENT DOCUMENTS

| | | |
|---|---|---|
| 2011286 | 2/1971 | (DE) . |
| 2735521 | 2/1979 | (DE) . |
| 3022409 | 1/1982 | (DE) . |
| 3613429 | 10/1987 | (DE) . |
| 326769 | 3/1930 | (GB) . |
| 474863 | 11/1937 | (GB) . |

OTHER PUBLICATIONS

"Electronic Toy Train Controls," Joseph L. Bonanno, *Electronics,* pp. 94–96 (Feb. 1947).

"A Cordless Walkaround Throttle," Don W. Hansen, *Model Railroader,* vol. 45 No. 5, pp. 3, 80–88 (May 1978).

*Model Railroader,* vol. 46, No. 4, pp 3, 13 (Apr. 1979).

"HO Radio Controlled Diesels," Trade Topics, *Model Railroader,* vol. 46, No. 6, pp. 3, 38 (Jun. 1979).

"Towards Reliable Operation," John Armstrong, *Model Railroader,* vol. 46, No. 9, pp. 3, 72–79 (Sep. 1979).

"Hi–Country Brass MRC Radio Control Power Packs," *Model Railroader,* vol. 46, No. 10, pp. 3, 10–11 (Oct. 1979).

"Commercial Command Control Systems," Andy Sperandeo, *Model Railroader,* vol. 46, No. 11, pp. 3, 80–81 (Nov. 1979).

"A Pulse–Tone, Walkaround Control System," Peter J. Thorne, *Model Railroader,* vol. 48, No. 2, pp. 3, 84–88 (Feb. 1981).

(List continued on next page.)

*Primary Examiner*—Mark T. Le

(57) ABSTRACT

A control circuit which will momentarily apply a pulse of power to the E-Unit solenoid in response to the momentary interruption of power by the transformer or another control signal. The E-Unit rest state is thus with no power applied, eliminating noise and saving power. A seek-to-forward cycling capability is also provided. The overall system has a remote transmitter and a base unit coupled to the train tracks with a receiver. The base unit controls track switching and individual trains through FSK signals transmitted over the track. The base unit also controls a triac switch between the transformer and the track to allow remote control of track power and impose DC offsets on the track power signal.

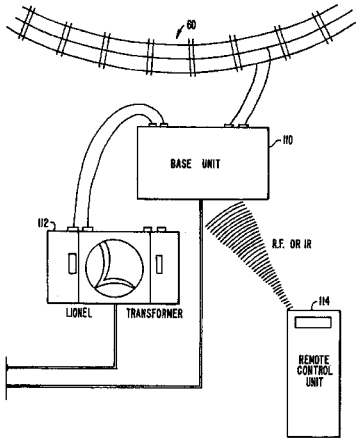

OTHER PUBLICATIONS

"Command Control/Sound System," Trade Topics, *Model Railroader,* vol. 48, No. 12, pp. 3, 48–54 (Dec. 1981).
"Symposium on Electronics," Don W. Hansen, *Model Railroader,* vol. 49, No. 3, pp. 3, 86–89 (Mar. 1982).
"Command Control Comes to the Sunset Valley," Bruce Chubb, *Model Railroader,* vol. 50, No. 1, pp. 3, 103–109 (Jan. 1983).
"CTC–16e: Command Control's Next Generation," Keith Gutierrez, *Model Railroader,* vol. 51, No. 4, pp. 3, 85–90 (Apr. 1984).
"Building the CTC–16e: 2," Keith Gutierrez, *Model Railroader,* vol. 51, No. 5, pp. 3, 84–91 (May 1984).
"Building the CTC–16e: 3," Keith Gutierrez, *Model Railroader,* vol. 51, No. 6, pp. 3, 68–72 (Jun. 1984).
"Building the CTC–16e: 4," Keith Gutierrez, *Model Railroader,* vol. 51, No. 7, pp. 3, 66–71 (Jul. 1984).
"Building the CTC–16e: Conclusion," Keith Gutierrez, *Model Railroader,* vol. 51, No. 8, pp. 3, 86–93 (Aug. 1984).
"Symposium on Electronics," Don Hansen, *Model Railroader,* vol. 52, No. 2, pp. 3, 116–121 (Feb. 1985).
"The C/MRI: A Computer/Model Railroad Interface," Bruce Chubb, *Model Railroader,* vol. 52, No. 2, pp. 3, 92–97 (Feb. 1985).
"The C/MRI: A Computer/Model Railroad Interface," Bruce Chubb, *Model Railroader,* vol. 52. No. 3, pp. 3, 92–98 (Mar. 1985).
"The C/MRI: A Computer/Model Railroad Interface," Bruce Chubb, *Model Railroader,* vol. 52. No. 4, pp. 3, 90–99 (Apr. 1985).
"The C/MRI: A Computer/Model Railroad Interface," Bruce Chubb, *Model Railroader,* vol. 52. No. 5, pp. 3, 92–99 (May. 1985).
"The C/MRI: A Computer/Model Railroad Interface," Bruce Chubb, *Model Railroader,* vol. 52. No. 5, pp. 3, 80–88 (Jun. 1985).
"Build an Inexpensive Walkaround Throttle," Kirk Wishowski, *Model Railroader,* vol. 53, No. 1, pp. 3, 118–122 (Jan. 1986).
"The C/MRI: A Computer/Model Railroad Interface," Bruce Chubb, *Model Railroader,* vol. 53. No. 8, pp. 3, 98–108 (Aug. 1986).
"Symposium on Electronics," Don W. Hansen, *Model Railroader,* vol. 53, No. 9 pp. 102–105 (Sep. 1986).
"CTC80 Command Control," Richard C. Kamm, *Model Railroader,* vol. 55, No. 3, pp. 3, 84–87 (Mar. 1988).
"Computers /in Model Railroading," Bob Fink, *Model Railroader,* vol. 55, No. 6, pp. 3, 66–69 (Jun. 1988).
"Wireless Walkaround Control for the CM&SF," Ken Thompson, *Model Railroader,* vol. 56, No. 8, pp. 3, 67–71 (Aug. 1989).
"Wireless Cab Control for the Great Southern," Lorell Joiner et al., *Model Railroader,* vol. 57, No. 1, pp 92–95 (Jan. 1990).
"Wireless Remote Control," John Atkinson, *Model Railroader,* vol. 57, No. 5, pp. 41, 43, 46 (May. 1990).
"The ABC's of Command Control," Keith Thompson, *Model Railroader,* vol. 60, No. 6, pp. 4–5, 104–106 (Jun. 1993).
"Command Control Roundup," Keith Thompson, *Model Railroader,* vol. 60, No. 7, pp. 88–93 (Jul. 1993).
"New Standards Proposed for Command Control," Stan Ames et al., *Model Railroader,* vol. 60, No. 10, pp. 4–5, 104–106 (Oct. 1993).
"Standards for Command Control?" Andy Sperandeo, *Model Railroader,* vol. 60, No. 10, pp. 4–5, 65 (Oct. 1993).
"Introducing the CTC–16", Gutierrez, 46 Model Railroader No. 12 (Dec. 1979), cover page and pp. 64–67.
"The CTC–16: Part 2—the command station", Gutierrez, 47 Model Railroader No. 1 (Jan. 1980), cover page and pp. 86–93.
"CTC–16: Part 3—the power station", Gutierrez, 47 Model Railroader No. 2 (Feb. 1980), cover page and pp. 89–92.
"The CTC–16: Part 4—handheld throttles", Gutierrez, 47 Model Railroader No. 3 (Mar. 1980), cover page and pp. 89–93.
"The CTC–16: Part 5—receivers", Gutierrez, 47 Model Railroader No. 4 (Apr. 1980), cover page and pp. 71–77.
"The CTC–16: epilogue", Gutierrez, 47 Model Railroader No. 12 (Dec. 1980), cover page and pp. 132–136.
"Build the wireless throttle: 1", Gutierrez, 50 Model Railroader No. 3 (Mar. 1983), cover page and pp. 86–95.
"Build the wireless throttle: 2", Gutierrez, 50 Model Railroader No. 4 (Apr. 1983), cover page and pp. 68–75.

* cited by examiner

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–9 is confirmed.

Claim 1 is determined to be patentable as amended.

Claims 2–4, dependent on an amended claim, are determined to be patentable.

New claims 10–26 are added and determined to be patentable.

1. A control system for model trains on a train track system comprising:

a hand-held remote control unit for transmitting control signals;

a transformer for applying *AC* track power to said track;

a base unit, connected between said transformer and said track, for receiving said control signals, and combining said control signals with said power on said track;

a train receiver unit, mounted in one of said model trains, for receiving said control signals, and directing the operation of said one model train in response to said control signals.

*10. The control system of claim 1 wherein said remote control unit transmits said control signals as radio frequency signals.*

*11. The control system of claim 1 wherein said remote control unit transmits said control signals as infrared signals.*

*12. The control system of claim 1 wherein each of said control signals includes an address and a command.*

*13. The control system of claim 12 wherein each of said control signals further includes a parameter value associated with said command.*

*14. The control system of claim 1 wherein said receiver unit includes a decoder coupled to said track.*

*15. The control system of claim 1 wherein said receiver unit includes a microcontroller that controls said one model train responsive to a set of said control signals, each control signal of said set of control signals having a predetermined address corresponding to said one model train.*

*16. The control system of claim 15 wherein said microcontroller controls a sound generator unit of said one model train.*

*17. The control system of claim 15 wherein said microcontroller controls a light controller of said one model train.*

*18. The control system of claim 15 wherein said microcontroller controls an uncoupler controller of said one model train.*

*19. The control system of claim 1 wherein said base unit includes:*

*a receiver that receives said control signals;*

*a microcontroller coupled to said receiver; and,*

*a driver circuit that controls a switch on said track responsive to said microcontroller.*

*20. The control system of claim 1 wherein said base unit includes:*

*a receiver that receives said control signals;*

*a microcontroller coupled to said receiver; and,*

*a frequency shift keyed transmitter that generates FSK signals responsive to said microcontroller.*

*21. The distributed processing control system of claim 7, further comprising a transformer connected to said base unit.*

*22. The distributed processing control system of claim 21 wherein said transformer applies AC power to a track of said model train track system.*

*23. The distributed processing control system of claim 7, wherein each of said control signals further includes a parameter value.*

*24. The distributed processing control system of claim 7, wherein one of said components comprises a model train.*

*25. The distributed processing control system of claim 7, wherein one of said components comprises a switch on a track.*

*26. The distributed processing control system of claim 7, wherein one of said components comprises a sound module.*

* * * * *